US009770104B1

(12) United States Patent
Reed

(10) Patent No.: US 9,770,104 B1
(45) Date of Patent: Sep. 26, 2017

(54) BLOCK PEDESTAL HAVING SLIDABLY SUPPORTED HORIZONTAL MEMBERS

(71) Applicant: PEDESTAL DESIGNS, INC., Boise, ID (US)

(72) Inventor: Petra Reed, Boise, ID (US)

(73) Assignee: PEDESTAL DESIGNS, INC., Boise, ID (US)

( * ) Notice: Subject to any disclaimer, the term of this patent is extended or adjusted under 35 U.S.C. 154(b) by 112 days.

(21) Appl. No.: 14/612,167

(22) Filed: Feb. 2, 2015

Related U.S. Application Data

(60) Continuation-in-part of application No. 13/385,637, filed on Feb. 27, 2012, now Pat. No. 8,943,983, which
(Continued)

(51) Int. Cl.
*A47B 47/00* (2006.01)
*A47F 5/10* (2006.01)
*A47F 5/00* (2006.01)

(52) U.S. Cl.
CPC ..... *A47B 47/0091* (2013.01); *A47B 47/0058* (2013.01); *A47F 5/0093* (2013.01); *A47F 5/10* (2013.01)

(58) Field of Classification Search
CPC ..... B65D 19/00; B65D 19/06; B65D 19/08; B65D 19/12; B65D 19/14; B65D 19/16; B65D 19/22; A63H 33/04; A63H 33/06; A63H 33/08; A47G 29/00; F16M 11/00; A47B 47/0058; A47B 47/0091; A47F 5/0093; A47F 5/10
USPC ..... 108/29, 56.1, 56.3, 57.17, 57.18, 57.19, 108/57.21, 57.33, 181, 182, 91, 102, 139, 108/140, 158.12; 248/346.01, 346.02,
(Continued)

(56) References Cited

U.S. PATENT DOCUMENTS 198,050 A 12/1877 Scott
243,567 A 6/1881 Ireland
(Continued)

FOREIGN PATENT DOCUMENTS

WO 2007114933 A2 10/2007
WO 2007123782 A2 11/2007

OTHER PUBLICATIONS

International Search Report, International Application No. PCT/US2007/08444, Applicant: Pedestal Designs Inc., Date of mailing: Jul. 30, 2008.

(Continued)

*Primary Examiner* — Michael Safavi
(74) *Attorney, Agent, or Firm* — Pedersen and Company, PLLC; Ken J. Pedersen; Barbara S. Pedersen

(57) ABSTRACT

Pedestal components are stacked on top of each other in multiple layers, to form multiple display surfaces at different levels of the pedestal. Modular components may be secured together only by gravitational force, and may cooperate by slidable and/or rotatable engagement, for adjustment of a group of components into different configurations as desired. The pedestal may include two or more subassemblies each having two or more layers of components, wherein the subassemblies may be connected by components extending between and engaging multiple of the subassemblies so that some of the components are common to, and interchangeable in, multiple subassemblies.

17 Claims, 18 Drawing Sheets

Related U.S. Application Data is a division of application No. 11/732,215, filed on Apr. 2, 2007, now Pat. No. 8,127,696.

(60) Provisional application No. 60/789,548, filed on Apr. 4, 2006, provisional application No. 60/789,537, filed on Apr. 4, 2006.

(58) Field of Classification Search
USPC ..... 248/678; 446/115, 118, 125, 127; 52/666, 668; 211/189
See application file for complete search history.

(56) References Cited

U.S. PATENT DOCUMENTS

| | | | | |
|---|---|---|---|---|
| 283,090 | A | | 8/1883 | Farnum |
| 554,661 | A | | 2/1896 | Dolittle |
| 1,213,690 | A | | 1/1917 | Quinones |
| 1,214,928 | A | * | 2/1917 | Lachman ..... E04C 2/423 52/656.6 |
| 1,298,762 | A | | 4/1919 | Milligan |
| 1,331,862 | A | | 2/1920 | Claus |
| 1,437,867 | A | | 12/1922 | Sixta |
| 1,443,420 | A | | 1/1923 | Lennox |
| 1,870,005 | A | | 8/1932 | Gutsch |
| 2,023,300 | A | | 12/1935 | Barnett |
| 2,119,821 | A | | 6/1938 | Manley |
| D118,463 | S | | 1/1940 | West |
| 2,204,319 | A | | 6/1940 | Parsons et al. |
| 2,239,156 | A | | 4/1941 | Lewis |
| 2,377,904 | A | | 6/1945 | Roach |
| 2,692,107 | A | | 10/1954 | De Ridder et al. |
| 2,696,356 | A | | 12/1954 | Baumann |
| 2,883,764 | A | | 4/1959 | Stephens |
| 3,091,361 | A | | 5/1963 | Gawron |
| 3,131,656 | A | | 5/1964 | Houle |
| 3,161,986 | A | | 12/1964 | Stubbmann et al. |
| 3,176,676 | A | | 4/1965 | Caldwell |
| 3,297,166 | A | * | 1/1967 | Summers ..... A47J 37/0694 211/60.1 |
| 3,538,862 | A | | 11/1970 | Patriarca |
| D221,781 | S | | 9/1971 | Calgan |
| 3,654,877 | A | | 4/1972 | Barrett |
| 3,736,714 | A | | 6/1973 | Brenner |
| 3,741,404 | A | | 6/1973 | Jourdain |
| 3,756,169 | A | | 9/1973 | Dybvig |
| 3,858,495 | A | | 1/1975 | Gotwalt |
| 3,878,796 | A | | 4/1975 | Morrison |
| 3,942,654 | A | | 3/1976 | Warrick |
| 4,147,007 | A | | 4/1979 | Eppich |
| 4,169,417 | A | | 10/1979 | Gemvik |
| 4,181,281 | A | | 1/1980 | Kosak |
| 4,220,099 | A | | 9/1980 | Marchesano |
| 4,316,634 | A | | 2/1982 | Roesler |
| 4,397,246 | A | | 8/1983 | Ishida et al. |
| 4,408,741 | A | * | 10/1983 | Mimura ..... F16L 3/2235 248/68.1 |
| 4,409,770 | A | * | 10/1983 | Kawaguchi ..... A47J 41/022 220/592.27 |
| 4,424,753 | A | | 1/1984 | Eatherton |
| 4,511,034 | A | | 4/1985 | Pan |
| D287,677 | S | | 1/1987 | Pomeroy et al. |
| 4,687,167 | A | | 8/1987 | Skalka et al. |
| 4,760,802 | A | | 8/1988 | Leong |
| 4,761,930 | A | | 8/1988 | Tepera |
| 4,781,643 | A | | 11/1988 | Holloway et al. |
| 4,798,361 | A | | 1/1989 | Fawcett |
| 4,841,879 | A | | 6/1989 | Ferguson |
| 4,841,880 | A | | 6/1989 | Ferguson |
| 4,955,490 | A | | 9/1990 | Schafer |
| D321,101 | S | | 10/1991 | Zucker |
| 5,101,737 | A | | 4/1992 | Gomez |
| D328,536 | S | | 8/1992 | Ma |
| 5,269,231 | A | | 12/1993 | Johnson |
| 5,272,990 | A | | 12/1993 | Carter |
| 5,353,716 | A | | 10/1994 | Wilbert |
| 5,425,198 | A | | 6/1995 | Coy |
| 5,425,314 | A | | 6/1995 | MacFarland |
| 5,440,998 | A | | 8/1995 | Morgan et al. |
| 5,463,786 | A | * | 11/1995 | Mangone ..... E01D 19/125 14/73 |
| 5,487,345 | A | | 1/1996 | Winebarger et al. |
| 5,537,937 | A | | 7/1996 | Juvik-Woods |
| 5,577,344 | A | | 11/1996 | Zaremba et al. |
| 5,628,415 | A | * | 5/1997 | Mulholland ..... A47B 47/027 211/186 |
| 5,662,048 | A | | 9/1997 | Kralj et al. |
| 5,676,251 | A | | 10/1997 | Credle |
| 5,687,653 | A | | 11/1997 | Bumgarner |
| 5,718,178 | A | | 2/1998 | Smith |
| 5,785,530 | A | | 7/1998 | Smith |
| 5,829,602 | A | | 11/1998 | St. John Danko |
| 5,830,032 | A | | 11/1998 | Campbell |
| 5,842,425 | A | | 12/1998 | Van Der Aa |
| 5,887,513 | A | | 3/1999 | Fielding et al. |
| 5,941,179 | A | * | 8/1999 | Herring ..... B65D 19/0091 108/56.3 |
| 5,967,056 | A | | 10/1999 | Plante |
| 5,971,830 | A | | 10/1999 | Tobin |
| 5,996,819 | A | | 12/1999 | Klein |
| 5,996,820 | A | | 12/1999 | Broadnax |
| 6,039,192 | A | | 3/2000 | Hollander |
| 6,041,719 | A | | 3/2000 | Vidal et al. |
| 6,095,468 | A | | 8/2000 | Chirico et al. |
| 6,158,360 | A | | 12/2000 | Cheng |
| 6,182,841 | B1 | | 2/2001 | Klein |
| D446,043 | S | | 8/2001 | Stoppenhagen et al. |
| 6,314,869 | B1 | | 11/2001 | Bourgeois |
| D453,372 | S | | 2/2002 | Pecoskie |
| 6,345,466 | B1 | | 2/2002 | Venanzi |
| 6,360,884 | B1 | | 3/2002 | Smith et al. |
| 6,505,804 | B1 | | 1/2003 | Francis et al. |
| 6,688,573 | B2 | | 2/2004 | Reed et al. |
| 6,877,442 | B2 | | 4/2005 | Helle |
| 6,915,994 | B2 | | 7/2005 | Oddsen |
| 6,938,558 | B1 | | 9/2005 | Peres |
| 7,004,437 | B2 | | 2/2006 | Bauer et al. |
| 7,399,090 | B2 | | 7/2008 | Oda |
| 7,407,144 | B2 | | 8/2008 | Reed et al. |
| 7,490,561 | B1 | | 2/2009 | Chou |
| 7,673,843 | B2 | | 3/2010 | Reed |
| 7,722,005 | B2 | | 5/2010 | Reed et al. |
| 7,856,933 | B2 | | 12/2010 | Miller et al. |
| 7,922,492 | B2 | | 4/2011 | Nielsen et al. |
| 8,127,696 | B2 | | 3/2012 | Reed et al. |
| 8,286,563 | B2 | | 10/2012 | Low |
| 8,943,983 | B2 | | 2/2015 | Reed et al. |
| 9,119,486 | B2 | | 9/2015 | Reed |
| 2003/0007321 | A1 | | 1/2003 | Dayley |
| 2003/0104098 | A1 | | 6/2003 | Schrader |
| 2004/0124324 | A1 | * | 7/2004 | Reed ..... A47B 13/003 248/146 |
| 2004/0164653 | A1 | | 8/2004 | Winkless |
| 2004/0226490 | A1 | | 11/2004 | Polumbaum |
| 2004/0226492 | A1 | | 11/2004 | Carter |
| 2005/0081764 | A1 | | 4/2005 | Michaels et al. |
| 2005/0166804 | A1 | | 8/2005 | Hansen |
| 2006/0096508 | A1 | | 5/2006 | Herring |
| 2008/0011206 | A1 | | 1/2008 | Warriner |
| 2008/0066657 | A1 | | 3/2008 | Kuo |
| 2008/0163801 | A1 | | 7/2008 | Gamba et al. |
| 2014/0054253 | A1 | | 2/2014 | Reed |

OTHER PUBLICATIONS

International Search Report, International Application No. PCT/US2007/08041, Applicant: Pedestal Designs Inc., Date of mailing: Aug. 26, 2008.

* cited by examiner

BLOCK PEDESTAL HAVING SLIDABLY SUPPORTED HORIZONTAL MEMBERS

CROSS-REFERENCE TO RELATED APPLICATIONS

This application is a continuation-in-part application claiming priority of Non-Provisional application Ser. No. 13/385,637, filed Feb. 27, 2012 and issued on Feb. 3, 2015 as U.S. Pat. No. 8,943,983, the disclosure of which is incorporated herein by this reference, wherein Ser. No. 13/385,637 is a Divisional Application of Non-Provisional application Ser. No. 11/732,215, filed Apr. 2, 2007 and issued on Mar. 6, 2012 as U.S. Pat. No. 8,127,696, which claims priority from Provisional Application No. 60/789,548, filed Apr. 4, 2006, and Provisional Application No. 60/789,537, filed Apr. 4, 2006, and is related to (1) application Ser. No. 10/734,868, filed Dec. 12, 2005 and issued on Aug. 5, 2008 as U.S. Pat. No. 7,407,144, and (2) application Ser. No. 10/117,686, filed Apr. 5, 2003, issued on Feb. 10, 2004 as U.S. Pat. No. 6,688,573, and (3) application Ser. No. 09/905,702, filed Aug. 2, 2001, now abandoned. Ser. No. 11/732,215 is also related to application Ser. No. 11/732,229, filed Apr. 2, 2007, and issued on Mar. 9, 2010 as U.S. Pat. No. 7,673,843, which claims priority from U.S. Provisional Application No. 60/789,537, filed Apr. 4, 2006. The disclosure of each of the above-identified applications and patents is incorporated herein by reference for all purposes.

BACKGROUND OF THE INVENTION

This invention relates to pedestals. The term "pedestal" is used herein to denote a structure which can be placed on a surface, often a horizontal surface, for example on the earth, on the floor of a building, or on an elevated surface (for example a buffet or other table, sideboard or desk) and which will support objects (e.g. tableware of all kinds, foodstuffs for consumption, and other objects being displayed for commercial and/or aesthetic purposes), hereafter called "display objects", placed on top of, or at intermediate levels of, the pedestal. For example, pedestals are used in the catering and hospitality industry to support display objects such as serving dishes, containers, platters, trays, jugs, glasses, bottles, cutlery, ice sculptures and flower vases at positions chosen for functional and/or decorative reasons.

Publication No. US 2004/0124324 discloses pedestals comprising a pedestal base and a plurality of parallel support members slidably fitted into channels in the upper surface of the pedestal base. The pedestal base of Publication No. US 2004/0124324 can for example be (i) a hollow tube having the channels in its upper periphery, (ii) two or more separate or interlocking wall members which together provide the channels, or (iii) a single member having an undulating upper surface, the upper surface having the channels therein, and the undulations being such that the upper surface of the member, viewed from the side, is horizontal or corrugated.

SUMMARY

We have discovered, in accordance with the present invention, novel pedestals, and novel pedestal components are useful for making the novel pedestals and for other purposes. The invention may include novel kits comprising components which can be assembled to make the novel pedestals; methods for making the novel pedestals; and methods of displaying objects on the novel pedestals.

Certain embodiments comprise a pedestal comprising pedestal components (or "elements", "pieces", "members") stacked on top of each other in multiple layers, to form multiple display surfaces at different levels of the pedestal. Preferably, some or all of the components are secured together only by gravitational force. Certain of the components may be categorized as either "vertical components" (or "elements", "pieces", "members") or "horizontal components" (or "elements", "pieces", "members"), in view of their general shapes, and/or in view of their general roles of raising other components ("elements", "pieces", "members") vertically to create pedestal height or extending horizontally to create horizontal display surface(s). The references herein to vertical, horizontal, top, bottom, upper and lower assume that the pedestal is being used normally. However, the invention includes the possibility that the pedestal is in a different orientation, and the terms vertical and horizontal are used to include variations from the strictly vertical and strictly horizontal directions which do not have any substantial effect on the function of the components in question.

Contact between at least some of the pedestal components may comprise one or more of: i) slidable engagement that allows sliding of the component(s) relative to the component(s) directly above and/or directly below, ii) slidable engagement that allows sliding of the component(s) relative to the component(s) directly above or directly below in at least one direction (for example, horizontally) and preferably two directions (horizontally and vertically); iii) mating engagement of projections and recesses/channels, wherein said mating engagement preferably allows sliding of the mated components relative to each other, iv) mating and/or slidable engagement of pedestal components that are held in position relative to each other after assembly and during use by gravity; and v) mating and/or slidable engagement of pedestal components that are held in position relative to each other after assembly and during use only by gravity, specifically not by screws, nails, adhesive, ties, straps, clips, or other fasteners; vi) detachable engagement; vii) detachable engagement by only means of lifting and/or sliding component(s) off a stack of the components; or viii) rotatable engagement that allows a component to be rotated to multiple operable positions.

In certain embodiments, the pedestal comprises a horizontal component called a pedestal "platform", a vertical component(s) called a "base" slidably engaging the platform and having a horizontal upper surface that comprises at least one recess and at least one projection, preferably defining one or more open channels (referred to herein, for identification purposes, as "base channels"), and one or more horizontal components called "lower support members", wherein each lower support member is slidably provided in one or more of the base channels. In preferred embodiments, a plurality of base channels are sized and spaced so that multiple lower support members are horizontal and parallel to each other. In preferred embodiments, each base channel is sized in depth so that the upper surface of each lower support member is above the base upper surfaces adjacent to the lower support member. In certain embodiments, a plurality or each of the lower support members has a constant cross section, for example, a constant cross-section of a rectangular, square, hollow rectangular, hollow square, U-shaped, or semi-circular shape. In certain embodiments, the cross-section of a plurality or each of the lower support members is non-circular and/otherwise made so that the lower support members will not rotate freely inside said base channels. In certain embodiments, a plurality or each of the lower support members has a flat and solid upper surface, lying on a horizontal plane, to serve as a surface for receiving display objects, or for supporting additional pedestal elements that are slidably stacked on top of the lower support members.

In certain embodiments comprising a platform, the platform comprises at least one projection and at least one recess that slidably engage with cooperating projection(s) and recess(es) on the bottom surface of the base. Preferably the platform projection(s) and recess(es) are parallel, and preferably form open channels that may be open-ended or closed-ended. In order to allow adjustment of the base to many locations on the platform, the channels preferably extend all the way, nearly all the way (80-99% of the way), or substantially all the way (at least 50% of the way) across the platform upper surface.

In certain embodiments comprising a platform, the other pedestal components do not extend beyond the outer perimeter of the platform, while, in other embodiments, a portion of one or more of the other components extends beyond the outer perimeter of the platform. For example, an end or ends of a base or lower support member(s) may protrude a distance beyond the platform outer perimeter, but preferably with the center of gravity of each component over its supporting components and over the platform rather than beyond the platform perimeter. Also, preferably, the components in such embodiments do not extend so far as to allow objects being displayed on them to force the component and the object to flip, tilt, or fall away from the pedestal.

Alternative pedestal embodiments comprise stacked vertical components and horizontal components, wherein said platform horizontal component is optional. For example, certain embodiments comprise said base (a vertical component), said at least one lower support member (a horizontal component), and at least one block (a vertical component) above said lower support member(s), with a platform underneath said base being optional. The block(s) rest on the lower support member(s), the base, or both, to stabilize the block(s) relative to said base and lower support member(s). In certain embodiments, each block may have a substantially constant, generally rectangular core cross-section, and top and bottom surfaces, and may be adapted for slidable engagement of the lower support member(s) by at least one recessed section and at least one projecting section being shaped and located on the block bottom surface so that the block fits slidably over at least one of said lower support members.

In certain embodiments, engagement of the block(s) with support members comprise at least one projection and at least one recess of the block(s) in the bottom surface of the block, preferably defining one or more open channels that each extend over one or more lower support members, or a projection that extends between two support members. Said recesse(s)/channel(s) and projection(s) are preferably sized so that the projection(s) on each side of a support member(s) (straddling the support members(s)), or in-between support members (protruding down between support members), may contact(s) the upper surface of the base when the block is directly over the base or a portion of the base. In certain embodiments, therefore, where the block is directly above the base, the block may contact and be supported by the base, with the lower support member(s) residing between the base and block but not supporting the block. However, when the block is over the support member(s) but not directly over the base, the recess(s)/channel surface(s) of the block contacts and rests on the upper surface(s) of the support member(s).

In certain embodiments, at least one upper support member (a horizontal component) rests on the upper surface of the block(s), to form yet another layer/level of the pedestal. In certain embodiments, said at least one upper support member slidable engages the upper surface, preferably by means of the block comprising at least one recess and at least one projection shaped and located so that the upper surface slidably receives at least one upper support member. In preferred embodiments, the at least one recess and at least one projection in the block upper surface define one or more open channels ("block channels") sized to be the same depth and width as the base upper surface channels. This way, upper support members and lower support members may be sized to have the same depth and width, so that the same components may be interchangeably used in either the lower or upper position, that is, in either the block upper surface channels or the base upper surface channels.

Preferably, at least one, preferably multiple, and most preferably all, layers of the pedestal slide both vertical and horizontally relative to the layer(s) below and/or above that layer. For example, upper support member(s) when present preferably slide vertically and horizontally relative to the block(s) below; block(s) preferably slide vertically and horizontally relative to the upper support member(s) above (if present) and relative to the lower support member(s) below (and the base if the block(s) contact the base); lower support members slide both vertically and horizontally relative to the block(s) above, and relative to the base(s) below; and, when a platform is present, the base preferably slides vertically and horizontally relative to the platform below. Said sliding vertically is typically done mainly or only during assembly to stack the components. Said sliding horizontally is typically done mainly or only during adjusting the assembled pedestal to a desired configuration, for example, to fine-tune the position of the various components relative to each other to optimize the display surfaces for a given use and to set the final visual setup/layout. The components of the preferred pedestals, for example, vertical components and horizontal components, including upper support member(s) when present, block(s), lower support member(s), base, and platform when present, are secured to each other only by gravitational force, and not by nails, screws, clips, glue, hardware, or other fasteners. Thus, the components form a modular pedestal system that is easily formable from multiple components in multiple layers, and easily adjustable to many different shapes, heights, lengths and widths, and setup formations, to suit the needs and preferences of the user and the space.

In certain embodiments, vertical components used in different locations in the stack of pedestal layers, for example, the base and block positions, may be the same structure or generally the same structure. Hence, in certain embodiments, bases, base portions, and blocks all comprise a bottom surface with at least one projection and at least recess, for slidably engaging a component(s) directly below them in the pedestal stack, and all may be selected from the same group of components that are called herein "vertical components". In certain embodiments, bases, base portions, and blocks all comprise an upper surface with at least one projection and at least recess, for slidably engaging a component(s) directly above them in the pedestal stack, and all may be selected from the same group of components that are called herein "vertical components". Thus, whether a "vertical component" is called "base", "base portion", or "block" (or the plurals thereof) is determined by its location in the stack of pedestal layers.

In certain embodiments comprising a platform, multiple platforms are provided, and each platform may support one or more pedestal components, forming multiple pedestal subassemblies. Pedestal components may extend between platforms/subassemblies, wherein pedestal component(s) are on each platform and at least one pedestal component extends through space between the platforms so that opposite ends of the component are supported/engaged by the multiple subassemblies but a portion of the component is suspended between the platforms. For example, an end or ends of a base, lower support member(s), block(s), or upper support member(s) may extend between the subassemblies by means of being supported/engaged, at or near each end, on one or more pedestal components on each of two platforms. Lower or upper support members are especially good candidates for extending between pedestal subassemblies due their lengths. The pedestal components of each subassembly may be different, for example, with components of different heights and/or of different numbers of layers of components.

It may be noted that the vertical components of FIGS. 27-37 each have adaptations on their bottom surfaces and their upper surfaces for engaging components that are below and above them, respectively, and may be used in multiple positions and layers of a pedestal, for example, as bases, base portions, or blocks.

Figure 40:
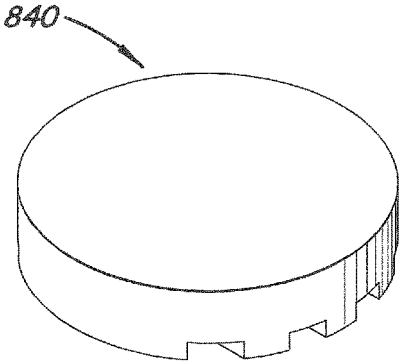
Figure 41:
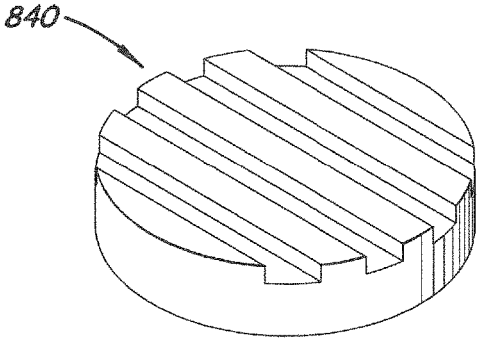

FIGS. 40 and 41 are top and bottom perspective views, respectively, of a "platter" vertical component that has four bottom channels for engaging support members, and a planer upper surface that preferably supports display objects, or that may optionally support other pedestal components.

Figure 42:
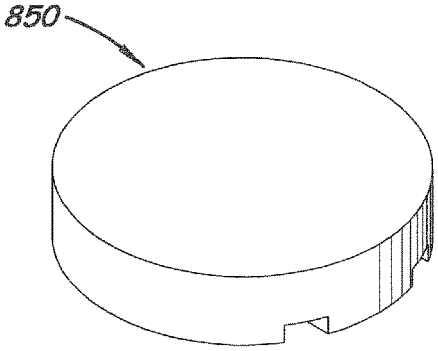
Figure 43:
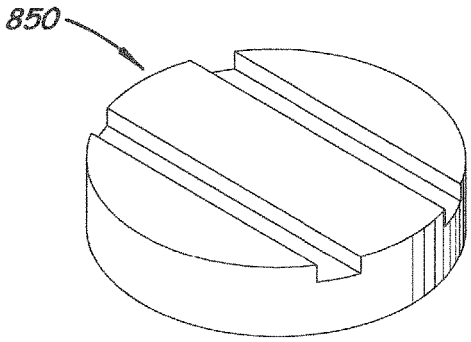

FIGS. 42 and 43 are top and bottom perspective views, respectively, of an alternative "platter" vertical component that has only two bottom channels, spaced farther apart than in the platter component of FIGS. 40 and 41, for engaging support members, and a planar upper surface that preferably supports display objects, or that may optionally support other pedestal components.

It may be noted that the components of FIGS. 38-43 each have adaptations on their bottom surfaces for engaging components below them, and a planar upper surface that preferably supports display objects, or that may optionally support other pedestal components.

Figure 44:
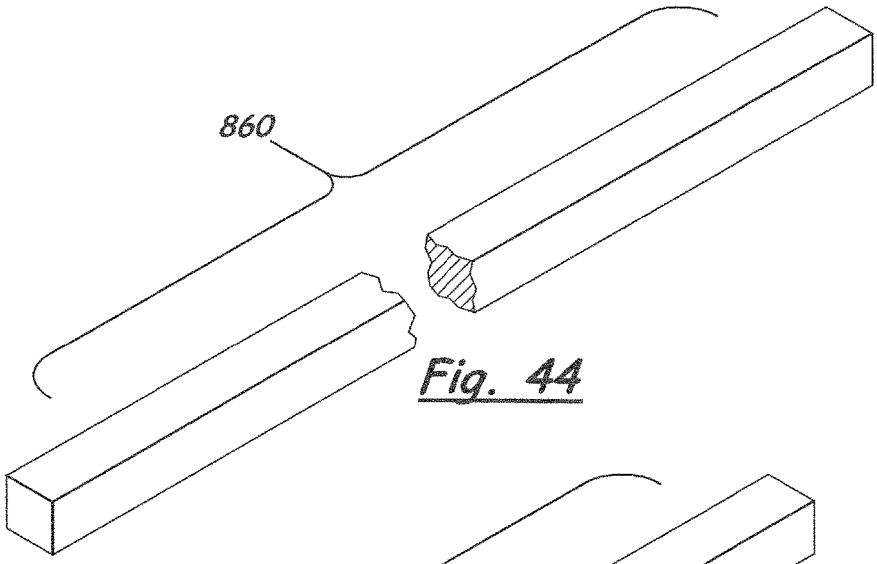
Figure 45:
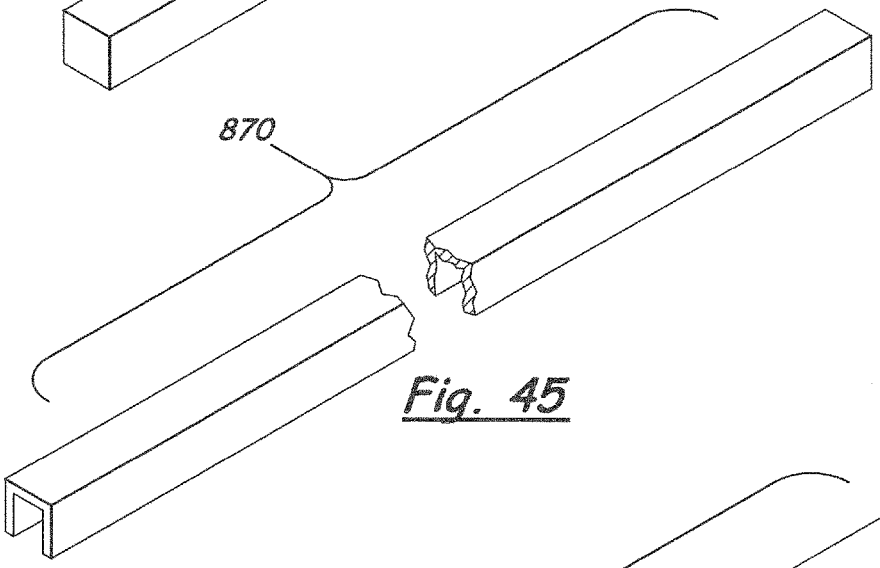
Figure 46:
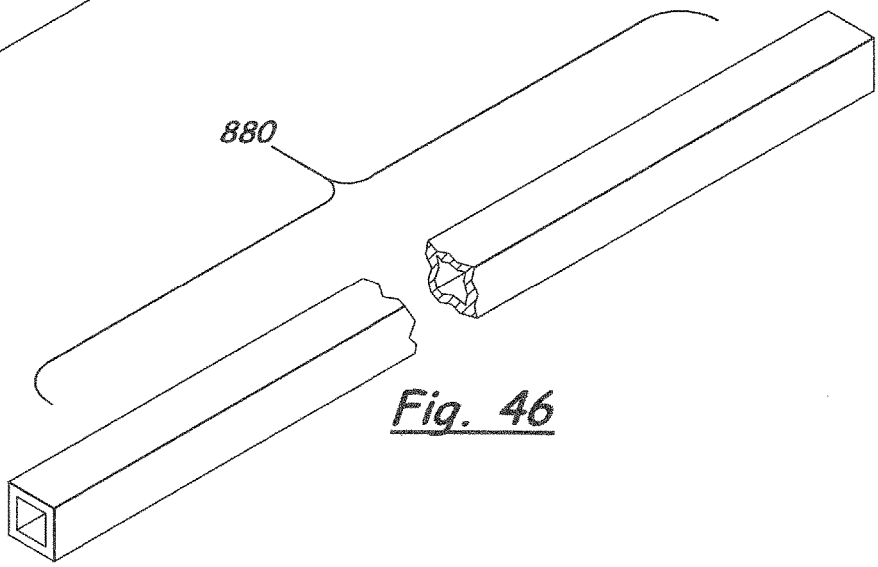

FIGS. 44-46 are perspective views of three horizontal components, which are support members, the figures each including a cross-sectional portion to illustrate the inside of the support members. These and other horizontal components are so-named because they have a length that is far greater than their width and their height, and have a main or only role of extending horizontally to create a horizontal support surface for display of objects.

FIGS. 47-51 are top perspective views of various pedestal assemblies comprising two pedestal subassemblies, including two adjacent platforms, and each comprising components that extend between the pedestals subassemblies on both platforms and that are engaged by a layer of each pedestal subassembly.

DETAILED DESCRIPTION OF PREFERRED EMBODIMENTS

In the Summary of the Invention above, and in the Detailed Description, and in the accompanying drawings, reference is made to particular features of the invented apparatus, and particular steps of methods of manufacture, assembly and use of the apparatus. It is to be understood that the disclosure of the invention in this specification includes all possible combinations of said particular features and all possible combinations of said particular steps. For example, where a particular feature is disclosed in the context of a particular aspect, a particular embodiment, or a particular Figure, that feature can also be used, to the extent appropriate, in the context of other particular aspects, embodiments, and Figures, and in the invention generally.

It is to be understood that pedestal components may be provided in different numbers, and with different dimensions, numbers of features and spacing of features, than those shown in the Figures, for customizing the pedestals for various uses and environments. For example, some bases in different pedestals, or in a single pedestal, may have different lengths, widths, and heights and/or have different numbers of engagement projections and/or recesses/channels than shown in the Figures. For example, some lower and/or upper support members in different pedestals, or in a single pedestal, may have different lengths, widths, and heights and/or be provided in different numbers than shown in the Figures. For example, some blocks in different pedestals, or in a single pedestal, may have different lengths, widths, and heights and/or have different numbers of engagement projections and/or recesses/channels than shown in the Figures. For example, some platforms when present may have different lengths, widths, and heights and/or have different numbers of engagement projections and/or recesses/channels than shown in the Figures.

The term "comprises" and grammatical equivalents thereof are used herein to mean that other elements (i.e. components, ingredients, steps etc.) are optionally present. For example, a pedestal "comprising" (or "which comprises") components A, B and C can contain only components A, B and C, or can contain not only components A, B and C but also one or more other components. The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4. When, in this specification, a range is given as "(a first number) to (a second number)" or "(a first number)-(a second number)", this means a range whose lower limit is the first number and whose upper limit is the second number. For example, "from 8 to 20 inches" or "8-20 inches" means a range whose lower limit is 8 inches, and whose upper limit is 20 inches. The terms "plural", "plurality", and "multiple" are used herein to denote two or more than two items.

Where reference is made herein to "first" and "second" elements (or components, pieces, or members), this is generally done for identification purposes; unless the context requires otherwise, the first and second elements can be the same or different, and reference to a first element does not mean that a second element is necessarily present (though it may be present). Where reference is made herein to "a" or "an" element, this includes the possibility that there are two or more such elements (except where the context excludes that possibility). Where reference is made herein to two or more elements, this includes the possibility that the two or more elements are replaced by a lesser number or greater number of elements providing the same function (except where the context excludes that possibility). The numbers given herein should be construed with the latitude appropriate to their context and expression; for example, each number is subject to variation which depends on the accuracy with which it can be measured by methods conventionally used by those skilled in the art.

Some of the components used in this invention are defined as having "a substantially constant generally rectangular core cross-section". Those components are also defined as having recessed and projecting sections and/or channels in their top and/or bottom surfaces. The term "core cross-section" is used herein to denote the largest-area cross-section which can be drawn by four straight lines within the actual cross-section of the component. The term "generally rectangular core cross-section" is used herein to denote any core cross-section which has a closed perimeter and which is rectangular or which provides the same functionality as a rectangular cross-section. Thus, the generally rectangular core cross-section can, for example, be a square; a rectangle whose height is substantially greater than, e.g. at least twice, its width; a rectangle whose height is substantially less than, e.g. less than 0.5 times, its width; a parallelogram; a trapezium; or a circle or an oval which has been modified so that the cross-section has flat top and bottom surfaces. The component can be solid, or it can contain one or more voids. The term "substantially constant" in the term "substantially constant generally rectangular core cross-section" means that the cross-section is constant, as is generally preferred, or varies (regularly or irregularly) in a way which provides the same functionality, and optionally the same appearance, as a constant cross section.

Vertical Components Cooperating with Support Members:

As noted above in the Summary, certain embodiments of vertical components that are the same structure or generally the same structure may be used in different locations in the stack of pedestal layers, for example, interchangeably in both the base and block positions. Hence, features described below when describing only one of either a "base" or a "block" may be understood to also apply to certain embodiments of the other. For example, vertical members that are called "base" or "pedestal base" may comprise one or more of the features, dimensions, and/or dimension ratios listed below in "Top Surface of Blocks" and "Other Optional Features of Blocks".

The pedestals of certain embodiments include one or more vertical members called "base" or "pedestal base" that cooperates with a plurality of lower support members and may cooperate with a platform. In some embodiments, the pedestal base and/or the support members are for example as disclosed in Publication No. US 2004/0124324 or one of the other documents incorporated by reference herein. In embodiments wherein the base upper surface comprises pairs of channels to provide open space underneath said midsection, 1-20 channel pairs may be provided, for example, with the preferred number of channel pairs being 2-8, more preferably 2-6 channel pairs, and most preferably 3, 4, or 5 channel pairs. In some embodiments, the base may be a member that has channels in the upper surface that receive the support members, rather than pairs of channels for receiving support members with open space underneath the midsection of the support members. For example, see base 12 in FIGS. 1-4 that may be considered a single-wall base with channels but not "pairs of channels", component 222 in FIGS. 15-17 that may be likened to a base in cooperation with a block 16, and component 710 being used as a base in subassembly 1220 in FIG. 51. In embodiments wherein the base upper surface has simply channels (rather than pairs of channels), 1-20 channels may be provided, for example, with the preferred number of channels being 2-8, more preferably 2-6 channels, and most preferably 3, 4, or 5 channels. In some embodiments, both of the type wherein the base comprises pairs of channels (to provide open space underneath said midsection) or simply channels, the bottom surfaces of the base may be planar, or may comprise at least one projection and at least one recess for cooperating with a platform, for example.

The pedestals of certain embodiments include one or more vertical members called "blocks" that are used in upper levels of the pedestal and that in certain embodiments engage at their upper surface with upper support members and/or may slidably engage at their bottom surface with lower support members. The blocks may have a top surface which comprises at least one recessed section and at least one projecting section. The blocks may have a bottom surface which comprises at least one recessed section and at least one projecting section. Preferably, when cooperating with lower support members, the block is horizontally slidable relative to the lower support members in a direction parallel to the lower support members. Preferably, when cooperating with upper support members, the block is also horizontally slidable relative to the upper support members in a direction parallel to the upper support members.

For example, in some embodiments, first and second blocks, which may be the same or different, cooperate at their upper surfaces with plurality of horizontal upper support members as well as cooperating at their bottom surfaces with lower support members, wherein each upper support member is slidably fitted into a block channel in the first block and a block channel in the second block. The upper support members may, for example, be at an angle, preferably a right angle, to the lower support members. In some embodiments, at least some, preferably all, of the upper support members are the same as at least some, preferably all, of the lower support members. In some embodiments, at least one, preferably all, of the upper support members and/or at least one, preferably all, of the lower support members are as disclosed in application Ser. No. 10/734,868 (Publication No. US 2004/0124324). In some embodiments, at least two, preferably all, of the upper support members and/or at least two, preferably all, of the lower support members extend upward from the channels in which they are fitted, so that one or more additional blocks can be slidably located on the upwardly-extending portions of the support members. Said upwardly-extending portions of the support members helping to prevent sideways sliding/falling of the blocks off of the pedestal because the support members extend up into the channels of said blocks.

For cooperation of certain blocks with the lower support members, the block bottom surface may be as follows: (A1) It comprises a single elongate projecting section and two elongate recessed sections, one on each side of the projecting section, so that the component can be slidably fitted over a pair of adjacent straight and parallel support members, with the projecting section between the support members and the recessed sections resting on the support members. (A2) It comprises a plurality of projecting sections, and a plurality of recessed sections, so that the component can be fitted, preferably slidably fitted, preferably vertically slidable for setting the component vertically down, over a plurality of adjacent straight, parallel and equispaced support members, with at least some of the projecting sections extending downwards between a pair of adjacent support members and at least some of the recessed sections resting on a support member. In one embodiment, there are two projecting sections, and three recessed sections, and the projecting sections are positioned and shaped so that the blocks can be placed in a number of different orientations over a plurality of parallel straight support members, for example so that the channels in the block are at right angles to, or parallel to, or at an angle (e.g. about 45.degree.) to, the support members. The projecting sections can for example have a round cross-section, or a regular polygonal, e.g. octagonal, cross-section. (A3) It comprises two projecting sections and a single recessed section between the two projecting sections, so that the component can be slidably fitted over a single straight support member or over a plurality of straight and parallel support members, with the recessed section resting on the support member or support members, and the projecting sections extending downwards adjacent to the side of a support member. (A4) The bottom surface of the component comprises a single projecting section and two elongate recessed sections, one on each side of the projecting section, the projecting section having a cross-section, e.g. a round cross-section, which enables it to rotate and to slide between a pair of adjacent straight and parallel support members, so that the component can be slidably and rotatably fitted over a pair of adjacent straight and parallel support members, with the projecting section between the support members and the recessed sections resting on the support members. The ability of the component to rotate can be through 360 degrees, or through some smaller angle, and the component can comprise stops or other means which enable a user to set the angle at a desired value and/or to recognize when the angle is at a desired value. (A5) It is such that the component can be slidably fitted over a support member or a plurality of support members as disclosed in application Ser. No. 10/734,868 (Publication No. US 2004/0124324). (A6) The projecting section or, if there is a plurality of projecting sections, at least one of the projecting sections, can be removed from the remainder of the intermediate component, and can optionally be replaced in the same or a different location in the intermediate component.

Top Surface of Blocks:

In certain embodiments, the top surface of the block may be of any kind. It can for example be planar, e.g. so that it can support display or serving objects, such as tableware, or it can have a non-planar configuration which fulfills a desired functional or decorative purpose. In the preferred novel block, the at least one recessed section and at least one projecting section of the block top surface preferably define at least one open channel, for example, 1-20 channels, or preferably 2-8, more preferably 2-6, and most preferably 3, 4, or 5, channels, wherein horizontal upper straight support members are preferably placed parallel to each other in the block channels.

The block channels may for example have one or more of the following characteristics. (B1) They are shaped and located so that it is possible to place a plurality of upper support members in the upper surface block channels so that the upper support members are at an angle, preferably at a right angle, to the lower support member or members over which the bottom surface of the block can be fitted; for example the block channels are at right angles to the projecting section(s) forming part of the bottom surface of the block. (B2) The distance between the upper surface block channels is substantially the same as the width of the projecting section or sections on the bottom surface. (B3) The height and/or width of the block channels in the top surface is substantially the same as the height and/or width of the recesses in the bottom surface. (B4) At least some, preferably all, of the block channels are such that support members as disclosed in application Ser. No. 10/734,868 (Publication No. US 2004/0124324) can be slidably fitted therein. (B5) There are 1-20 channels, 2 to 8 channels, 2 to 6 channels, 3 channels, 4 channels, or 5 channels. (B6) They are rectangular (including square) in cross-section. (B7) The block channels are sized and positioned, and the bottom surface of the block is configured, so that, if two upper support members are placed in two adjacent block channels, an identical block can be slidably fitted over two upper support members.

Other Optional Features of Blocks:

(C1) The block has block channels in its upper surface and may have at least one of the following features (i) a core cross-section which is rectangular (including square), (ii) the ratio of the width to the height of the core cross section is from 0.5:1 to 1:40, e.g. 1:1 to 1:6, for example 1.5:2 to 1:4, (iii) the area of the core cross section is 2 to 16, for example 3 to 8, square inches, and (iv) the block is 3 to 20 inches, e.g. 4 to 10 inches, long, and/or 1 to 6 inches, e.g. 1.5 to 3 inches wide, and/or 0.5 to 8 inches, e.g. 1 to 4 inches high. (C2) The block does not have block channels in its upper surface and has at least one of the following features (i) a core cross-section which is rectangular, (ii) the ratio of the width to the height of the core cross section is from 4:1 to 40:1, e.g. 10:1 to 30:1, for example 6:1 to 2:1, (iii) the area of the core cross section is 2 to 16, for example 3 to 8, square inches, and (iv) the block is 3 to 20 inches, e.g. 4 to 10 inches, long, and/or 1 to 6 inches, e.g. 1.5 to 3 inches wide, and/or 0.5 to 8 inches, e.g. 1 to 4 inches high. (C3) The sides of the block are free of channels. (C4) The block comprises (i) a bottom portion which provides the bottom surface, and (ii) a top portion which provides the top surface and which is rotatably connected to the bottom portion, so that when the bottom portion is fitted over one or more support members, the top portion can be rotated relative to the bottom portion. The ability of the top and bottom portions to rotate can be through 360 degrees or through some smaller angle, and the block can comprise stops or other means which enable a user to set the angle at a desired value and/or to recognize when the angle is at a desired value.

Support Members:

The support members that may cooperate with the vertical components may have any cross section which enables them to be slidably fitted into the open channels of the vertical component. Preferably, each of the support members has the same cross-section throughout its length. Preferably, each of the support members is straight throughout its length. Preferably all the support members have the same cross-section. Preferably the support members have a cross-section having three or more equal sides so that it is not necessary to rotate the member in order to achieve the right orientation for the open channel, for example a square, hexagonal or octagonal cross-section. It is also preferred, in order to enhance the lateral stability of the support members after they have been placed in the open channels, that each side of the support member has a vertical section adjacent to a vertical section of the channel. A square cross-section is particularly preferred. When the support member has a square cross-section, each side of the square can for example be 0.25 to 3, or 0.25 to 2, preferably 0.5 to 1.5 inch long. When the support member has a cross-section other than a square cross-section, the peripheral length of the cross section can for example be 0.75 to 12, preferably 2 to 6, inches.

Example Pedestals:

One example of a pedestal may be a pedestal wherein (A) the pedestal base comprises one or more pedestal bases, e.g. a pedestal base as disclosed in US Publication No. 2004/0124324, (B) the number of pairs of base channels in each pedestal base is from 3 to 6; (C) the number of the lower support members is from 3 to 6; (D) each of the lower support members is a straight support member slidably fitted into one of the pairs of base channels; (E) all the lower support members have the same cross section; and (F) the top surfaces of all the lower support members lie in the same horizontal plane.

Another example of a pedestal may be is a pedestal which comprises (A) a pedestal comprising a base that comprises first and second spaced-apart wall members ("base portions"), each wall member having a horizontal upper surface which defines 3-6 open base channels, the open base channels defining 3-6 pairs of open base channels, each pair comprising an open base channel in the first member and an open base channel in the second member; (B) 3-6 straight lower support members which are (i) parallel to each other, (ii) have top surfaces which lie in the same horizontal plane, and (iii) have the same cross section; each lower support member being slidably fitted into one of the pairs of open base channels, with a midsection of the lower support member lying between the base channels and having an open space underneath it; (C) a block which has (i) a substantially constant, generally rectangular core cross-section, and (ii) top and bottom surfaces, the bottom surface comprising two recessed sections and a projecting section, the projecting section lying between two adjacent lower support members and the recessed sections resting on the two adjacent lower support members, and the top surface of the block comprising a plurality of open block channels; and (D) 3-6 straight upper support members which are (i) placed parallel to each other in the block channels, (ii) are at right angles to the lower support members, (iii) have top surfaces which lie in the same horizontal plane, and (iv) have the same cross section, each of a support member being slidably fitted into one of the block channels.

Such a pedestal can for example further comprise (E) a third wall member which is higher than the first and second wall members and has a horizontal upper surface which defines a plurality of open base channels into which are slidably fitted the upper support members.

Alternatively or additionally, such a pedestal can for example further comprise (F) a second pedestal base which comprises third and fourth spaced-apart wall members (also third and fourth "base portions"), each wall member having a horizontal upper surface which defines 3-6 additional open base channels, the additional open base channels defining 3-6 pairs of open base channels, each pair comprising an open base channel in the third member and an open base channel in the fourth wall member; (G) 3-6 straight additional support members which are (i) parallel to each other, (ii) have top surfaces which lie in the same horizontal plane, and (iii) have the same cross section; each additional support member being slidably fitted into one of the pairs of open base channels defined by the third and fourth wall members, with a midsection of the additional support member lying between the base channels and having an open space underneath it; (H) a second block which has (i) a substantially constant, generally rectangular core cross-section, and (ii) top and bottom surfaces, the bottom surface comprising two recessed sections and a projecting section, the projecting section lying between two adjacent additional support members and the recessed sections resting on the two adjacent additional support members, and the top surface comprising a plurality of open block channels into which are fitted the upper support members.

Alternatively or additionally, a pedestal may comprise in certain embodiments a base that comprises base channels for receiving and supporting, and preferably slidably receiving and supporting, multiple lower support members, but does not comprise pairs of channels that support said lower support members with the midsections of the lower support members over an open space. For example, see base 12 in FIGS. 1-4 that may be considered a single-wall base with channels but not "pairs of channels", component 222 in FIGS. 15-17 that may be likened to a base in cooperation with a block 16, and component 710 being used as a base in subassembly 1220 in FIG. 51.

Further Example Pedestals Comprising a Platform:

Various embodiments of pedestals may be adapted to further comprise a platform, which may be described as a lower pedestal component that extends underneath and supports some or all upper pedestal components, and preferably extends underneath one or more, or all, of the vertical members serving as bases or base portions for a given pedestal or given pedestal subassembly. The platform has an upper surface that includes a plurality projections and recesses, preferably forming multiple platform channels. The platform channels serve to locate pedestal components which are placed on top of the platform, for example a base or base portions.

The bottom surface of the platform may be planar, so that it can be placed on a flat horizontal surface. Alternatively, the bottom surface may be adapted to engage the top ends/surfaces of a downward-extension assembly, for example, one or more pedestal vertical or horizontal components such as are described and drawn in this document. Alternatively, the bottom surface may be adapted to connect to, engage, cooperate with, or be integrally formed, with other downward-extension assemblies, for example, rectangular, square, round, cylindrical, oval, arches, curved, polygonal, and other shapes, that may serve as a wall(s), a foot or feet, pad(s), leg(s), strut(s), column(s), plinth(s), or other structure to raise the platform up off a table, floor, countertop, or other generally horizontal service and/or to provide space underneath the platform for display or storage of objects.

The platform can optionally have one or more of the following characteristics. (D1) Each of the length l and the width w is at least 10 times, for example, at least 20 times, or at least 40 times, the thickness h. (D2) It is sufficiently rigid to remain substantially planar when it is placed on an irregular generally horizontal surface, or on a downward-extending assembly (DE). (D3) The platform channels have a depth substantially equal to the depth of a projecting section on the bottom surface of a vertical component (used as a base), or a lesser depth, for example 0.04 to 0.25 inch, e.g. 0.04 to 0.125 inch. In certain embodiments, the components can be packed into any suitable container, optionally having compartments for different components, for example a customized box, bag, or cart, for example, a cardboard box, a fabric bag, or a cart on castors or wheels. The components can be selected, assembled by stacking, aligning, and sliding relative to each other, into a wide variety of multiple-layer pedestals of different functionalities, shapes, dimensions and decorative appearances. The modularity of the preferred pedestal components makes it possible for users to transport a kit of relatively small dimensions to, for example, a particular catering or display event, and to construct, on site, one or more pedestals adapted to the particular requirements of the event. The components are preferably such that, after the event, they can be easily disassembled, cleaned, and repacked as a compact kit for transport to storage or to another event.

Figure 1:
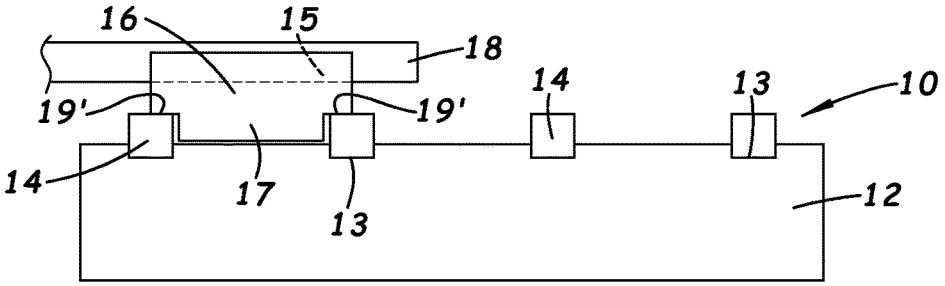
FIGS. 1-4 are schematic views of four, four-layer pedestal component assemblies, each comprising a base, multiple lower support members slidably fitted in the base channels, a block slidably fitted over the base and at least one of the lower support members, and at least one upper support member slidably fitted in at least one block upper surface channel.
Figure 2:
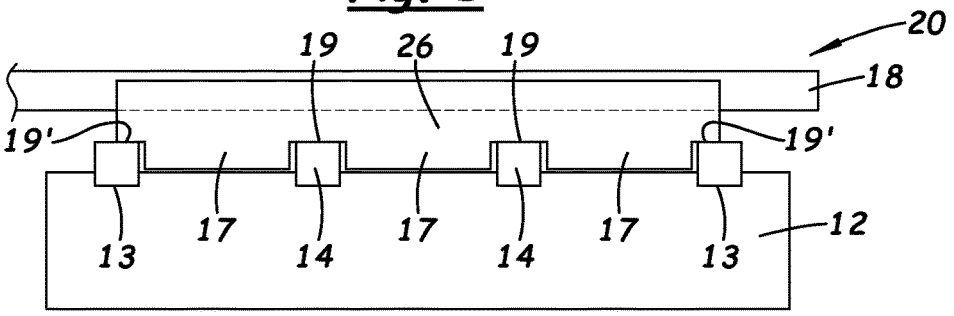
Figure 3:
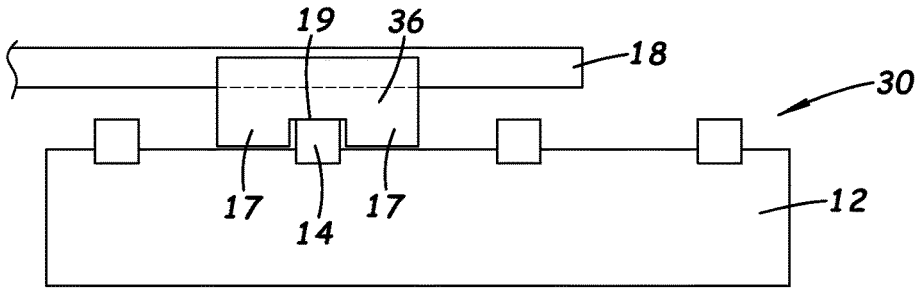
Figure 4:
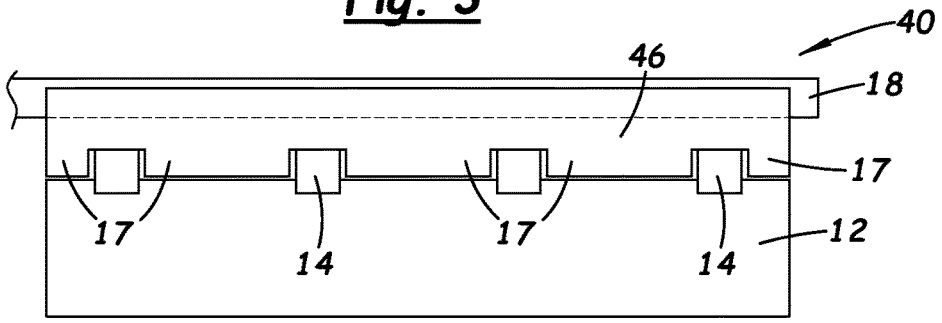
Figure 5:
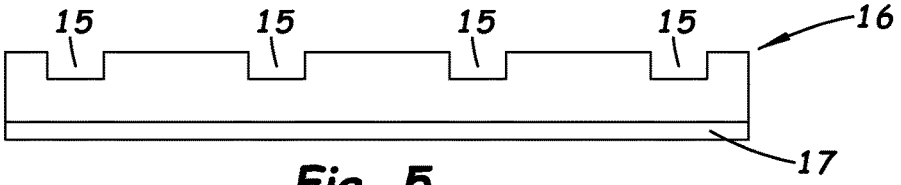
FIG. 5 is a schematic side view of the block that is shown in FIG. 1 in end view.
Figure 6:
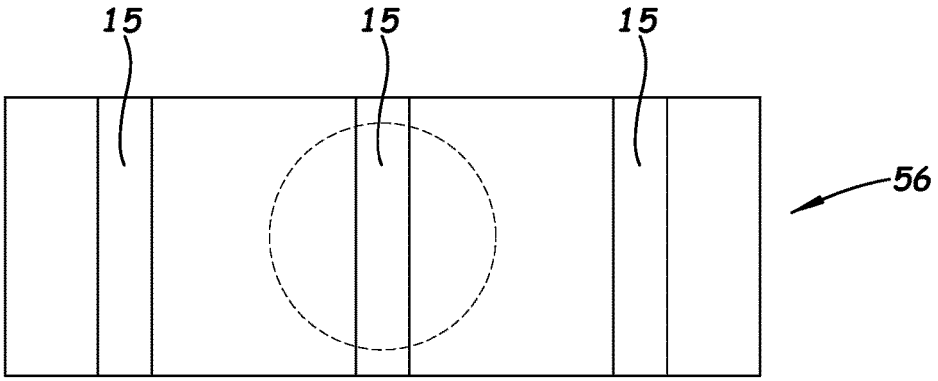
FIGS. 6 and 7 are schematic top and side views of another block having a cylindrical bottom projection.
Figure 7:
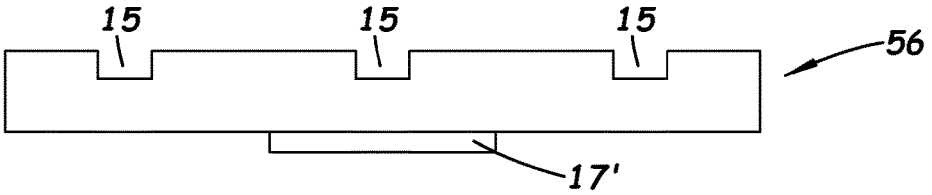
Figure 8:
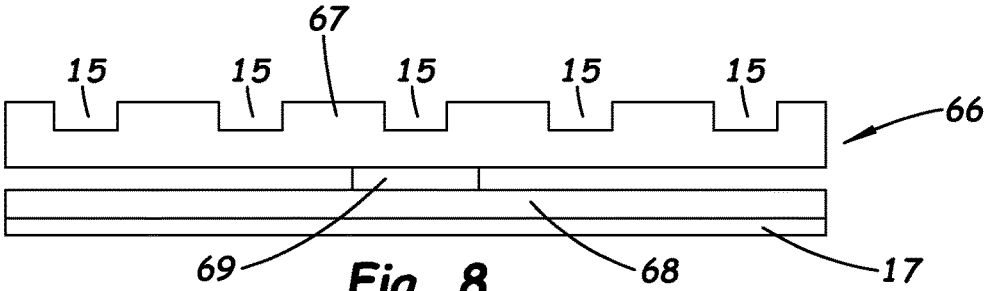
FIG. 8 is a schematic side view of another block having two portions that can be rotated 360 degrees relative to each other.
Figure 9:
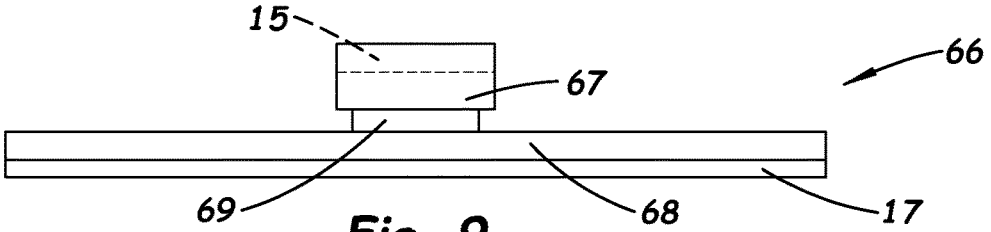
FIG. 9 is a schematic side view of the block of FIG. 8 after the top portion has been rotated 90 degrees.

Specifically Referring to the Figures:

Referring to the figures, one may see several, but not the only, embodiments of pedestal components and assembled pedestals. FIGS. 1-4 each illustrate a pedestal 10, 20, 30, 40 that has four layers, that is, a base 12, multiple lower support members 14, a block 16, 26, 36, 46, and at least one upper support member 18. The base 12 may have a flat bottom surface, for resting on a generally horizontal surface, and plurality of channels 13 in its upper surface that receive the lower support members 14. The block 16, 26, 36, 46 has an upper surface comprising at least one channel 15, and a bottom surface comprising one or more projections 17, or one or more recessed sections that may take the form of a channel 19 or an edge recess 19' at an edge of the block, for example. So, one may describe block 16 as having one projection 17 and two edge recesses 19'. One may describe block 26 as having three projections 17, two channels 19 and two edge recesses 19'. One may describe block 36 as having a two projections 17, and a single channel 19. One may describe block 46 as having five projections 17, and four channels 19. Although only one channel 15 is visible in the upper surface of the block 16, 26, 36, 46 in FIGS. 1-4, preferably there are multiple channels 15 as is shown in the side view of block 16 in FIG. 5.

For assembly or adjustment during use, each lower support member 14 preferably may be slid vertically into and out of its respective channel 13, and also horizontally parallel to its longitudinal axis relative to its respective channel 13. The vertical sliding will be most useful during the initial assembly of the pedestal, as the support members 14 may conveniently be set down into the channels 13. The horizontal sliding will be most useful during adjustment of the lower support members to a desired position relative to the base 12, for example, to achieve different functionalities, shapes, dimensions and decorative appearances of the pedestal.

Similarly, for assembly or adjustment during use, each block 16, 26, 36, 46 preferably may be slid vertically onto and off of the lower support members 14 and/or the base 12 that are selected to be the supporting components for the block. Preferably, each block 16, 26, 36, 46 is also horizontally slidable parallel to the projection(s) 17 or channel(s) 19 or edge recesses 19' in the bottom surface of the block. The vertical sliding will be most useful during the initial assembly of the pedestal, as the blocks 16, 26, 36, 46 may conveniently be set down onto the lower support members 14 and/or onto base 12 with lower support members 14 between the block 16, 26, 36, 46 and the base 12. The horizontal sliding will be most useful during adjustment of the blocks to a desired position relative to the base 12 and lower support members 14, for example, to achieve different functionalities, shapes, dimensions and decorative appearances of the pedestal.

Similarly, for assembly or adjustment during use, each upper support member 18 preferably may be slid vertically into and out of its respective channel 15 in the upper surface of the block 16, 26, 36, 46. Preferably, each upper support member 18 is also horizontally slidable parallel to its longitudinal axis relative to the channel 15. The vertical sliding will be most useful during the initial assembly of the pedestal, to set the support member(s) 18 down into the channel(s) 15. The horizontal sliding will be most useful during adjustment of the upper support member(s) 18 to a desired position relative to blocks, for example, to achieve different functionalities, shapes, dimensions and decorative appearances of the pedestal.

FIGS. 6-9 illustrate alternative vertical components 56 and 66 that may be used in pedestals. As with blocks 16, 26, 37, 46, these components 56, 66 will preferably be vertically and horizontal slidable relative to the pedestal component(s) on which the components 56, 66 are placed and relative to the pedestal component(s) that are placed on components 56, 66. A single cylindrical projection 17' depends from component 56 that, for example, may protrude down in between a pair of support members. Component 66 has two portions that can be rotated relative to each other, wherein a top portion 67 comprises upward-facing channels 15, a bottom portion 68 comprises a bottom projection 17, and a rotatable connection 69 connects the top and bottom portions.

Figure 10:
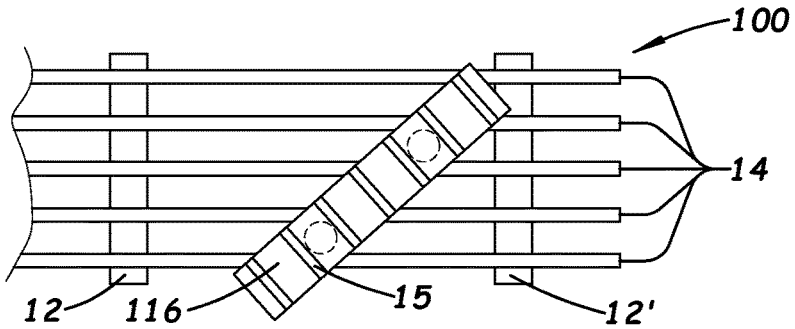
FIGS. 10-12 are schematic top views of an alternative pedestal assembly, wherein the block with cylindrical bottom projections is adjusted to three different positions in the three figures.
Figure 11:
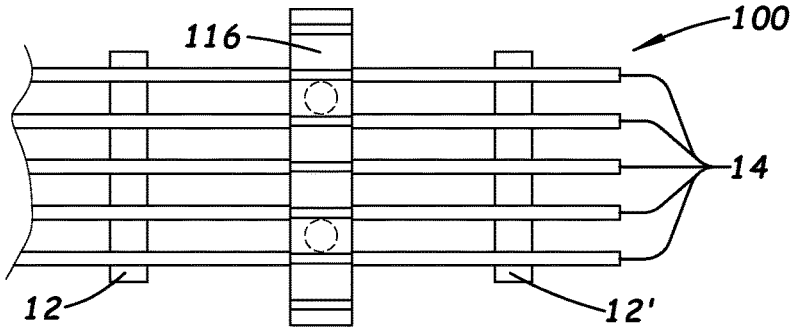
Figure 12:
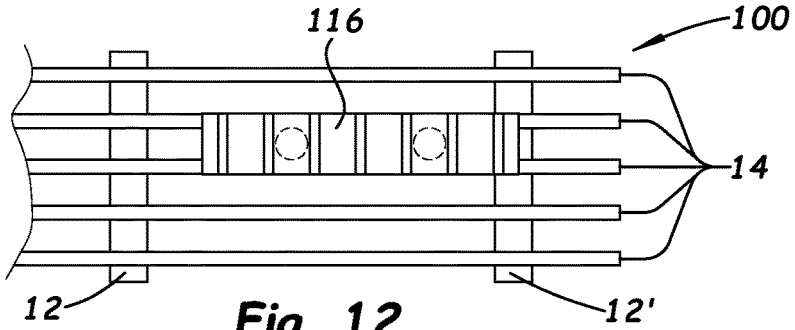
Figure 13:
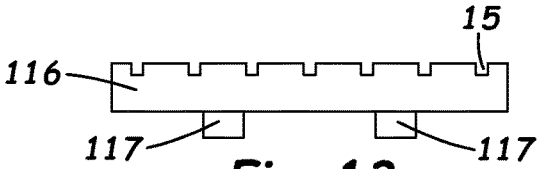
FIGS. 13 and 14 are schematic side and end views, respectively, of the block shown in FIGS. 10-12.
Figure 14:
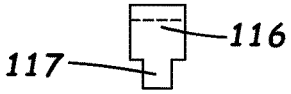

FIGS. 10-12 illustrate an alternative pedestal embodiment 100 including a set of lower support members 14 in base channels of a two-wall base 12, 12' and a block 116. The block 116 is fitted over selected lower support members 14, with the two generally cylindrical bottom projections 117 (or "of circular cross-section") spaced-apart from each other so that the block 116 can be placed on the same set of support members in three different orientations, with the projections 117 extending down between selected lower support members, and the block channels of the block being parallel to, at right angles to, or at an angle of about 45.degree. The lower support members 14 are preferably vertically and horizontally slidable relative to the two walls 12, 12' of the base, and the block 116 is preferably vertically and horizontally slidable relative to the lower support members 14, here with the horizontal sliding being parallel to the longitudinal axes of the lower support members 14. FIGS. 13 and 14 show the block 116 in side view and in end view, respectively.

Figure 15:
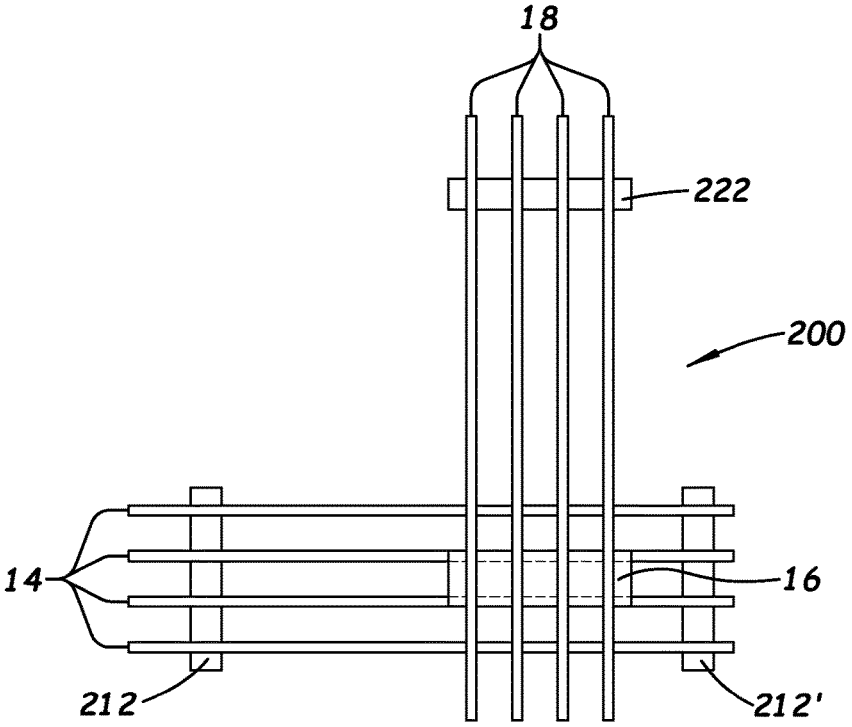
FIGS. 15, 16 and 17 are top, side and end views, respectively, of another pedestal embodiment, which comprises four layers at one side (the right in FIG. 17) and two layers at the other side (the left in FIG. 17).
Figure 16:
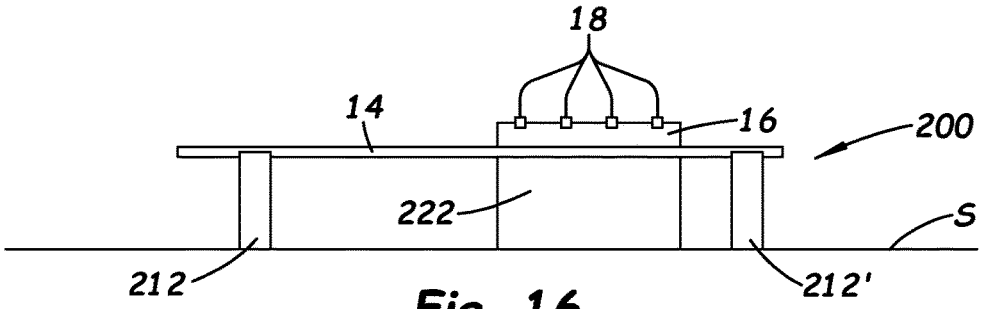
Figure 17:
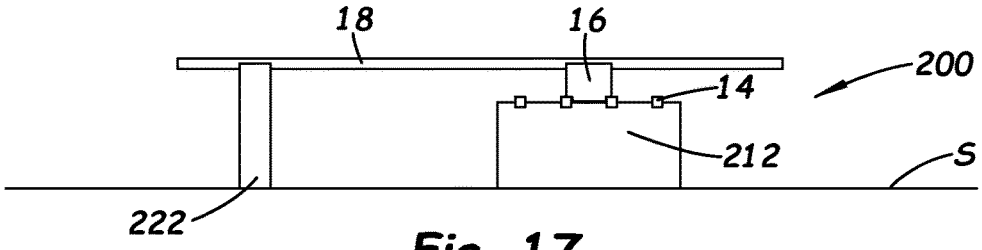

FIGS. 15-17 portray another pedestal 200, set upon surface S, that comprises four layers at one side (the right in FIG. 17) and two layers at the other side (the left in FIG. 17), by virtue of the tall wall member 222 supporting the upper support members 18 at the left of FIG. 17 being as tall as the combination of the two-walled base 212, 212', lower support members 14, and the block 16 at the right of FIG. 17. As in the discussion regarding the support members in FIGS. 1-4 and/or 10-12, the lower support members 14 are preferably vertically and horizontally slidable relative to the base 212, 212', the block 16 is vertically and horizontally slidable relative to the lower support members 14, and the upper support members 18 are horizontally slidable relative to the block 16 and to the tall wall component 222. Note that the bottom projection of the block 16 in these figures rests on only the lower support members 14, but may slide horizontally to be also above one or the other of the walls 212, 212' of the base, and may optionally contact the upper surface of said one or the other wall 212, 212' of the base when in that position.

Figure 18:
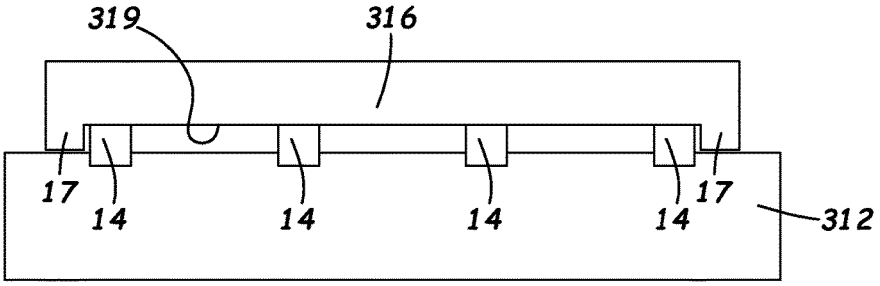
FIGS. 18 and 19 are schematic side and end views of another pedestal embodiment, with lower support members fitted into base channels of a base, and an alternative block is fitted over the lower support members, the block comprising a single channel wide enough to fit over multiple lower support members, for example, four lower support members in this embodiment.
Figure 19:
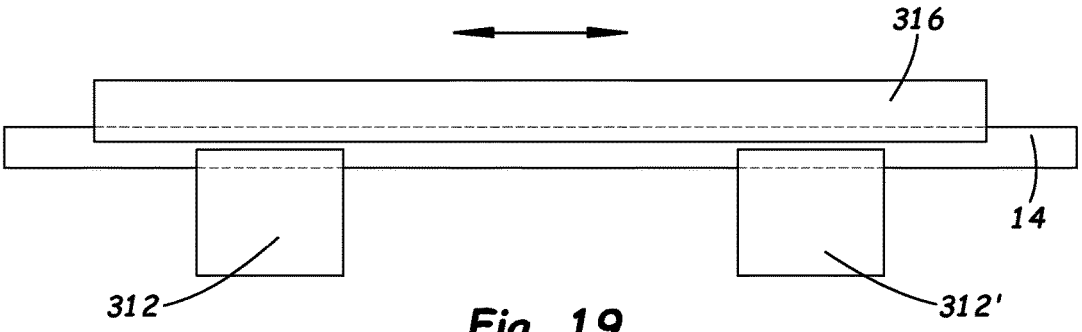

FIGS. 18 and 19 show an alternative block 316 having a substantially planar, flat, and continuous top surface and a bottom surface having a single recessed section and two projecting sections, so that one may describe the block 316 as having a single bottom surface channel 319 with two projections 17 on each side of the channel 319, the channel 319 fitting over four lower support members 14 and so typically being large compared to most channels fitting over a single support member. One may note from FIG. 19 that the base comprises two wall members 312, 312' that are both generally square in end view, which may be compared to the single-member base 12 of FIGS. 1-4, and to the taller-than-wide two-wall bases such as 12, 12', 212, 212' in FIGS. 10-12 and 15-17. The block 316 top surface may be an effective surface for display of objects wherein the user does not want to place said objects directly on lower support members or upper support members. It may be noted that, block 316 has generally flat, rectangular side and end surfaces, but other blocks may be made of other shapes, for example, the generally cylindrical vertical components shown in FIGS. 40-43, which also have planar/flat/continuous top surfaces for use as continuous surfaces for display. It may be noted that, in FIG. 18 as well as in FIGS. 2 and 4, some, but not all, of the lower support members 14 could be omitted without changing the functioning of the block, but all the lower support members might be useful for other purposes.

Figure 20:
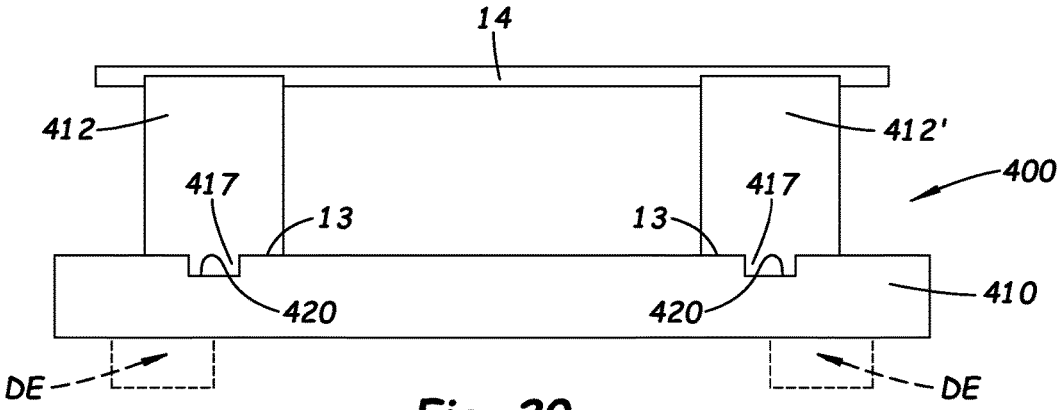
FIGS. 20-22 are side, top, and end views of another pedestal embodiment, comprising one embodiment of a platform supporting a two-walled base and multiple lower support members. These and certain other pedestal embodiments may be called "horizontal components" due to their role in extending horizontally to provide horizontal display surface and in that they are far wider and deep than high.
Figure 21:
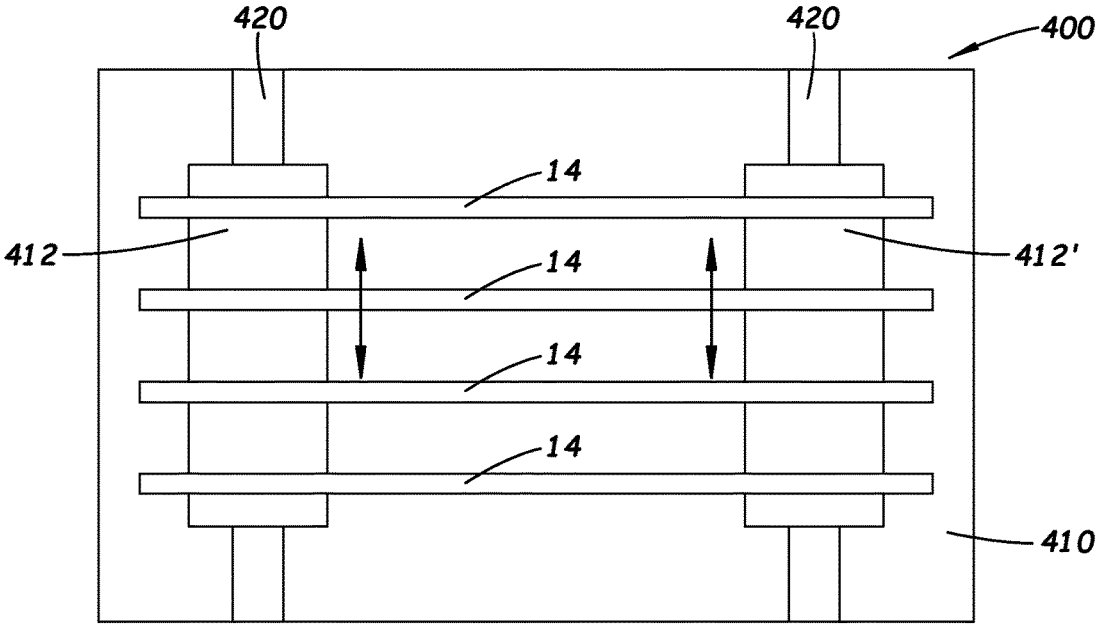
Figure 22:
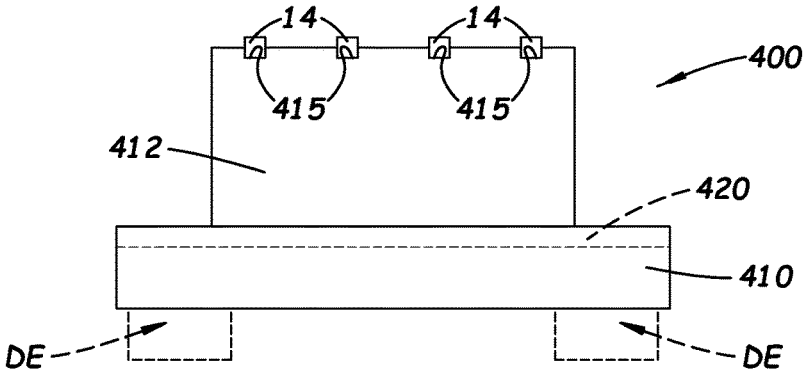

In FIGS. 20-22, a pedestal 400 is portrayed that comprises a platform 410 that extends underneath upper pedestal components that comprise two vertical components 412, 412' that may be considered a two-walled base, and lower support members 14 that are slidably received in channels 415 of the two-walled base 412, 412'. They comprise non-planar, non-flat bottom and upper surfaces that are adapted to engage the component below and the component(s) above, respectively, in a mated relationship. The two walls of the base 412, 412' are each adapted on their bottom surfaces to engage the platform 410, preferably by means of projection 417, so that the base portions 412, 412' are horizontally slidable relative to the platform 410 in the channels 420, parallel to the longitudinal axis of the base portions 412, 412' and to the channels 420, but to not move any significant amount relative to the platform 410 in a direction transverse to the channels 420.

The platform 410 may be for resting on a generally horizontal surface such as a table, floor, wall, shelf, countertop, etc, or a supplemental downward-extension assembly (DE), an exemplary version of which is shown in dashed lines in FIGS. 20 and 22. The supplemental downward-extension assembly may slidably, rotatably, or immovably connect to said platform 410, base 412, 412', for resting on the generally horizontal surface such as a table, floor, wall, shelf, countertop, etc.

Certain embodiments, including that shown in FIGS. 20-22, may be described as: A pedestal which comprises a horizontal component (or "element", "piece", or "member") which has a substantially constant generally rectangular core cross-section having a horizontal width w, and a height h, w being at least 10 times h, a horizontal dimension, l, measured at right angles to the width, which is at least 10 times h, and a horizontal upper surface which includes a plurality of configurations selected from straight open channels and straight projections; and a vertical component (or "element", "piece", or "member") which has a substantially constant, generally rectangular core cross-section, a horizontal bottom surface comprising at least one configuration which is a projecting section which fits slidably into a straight open channel in the upper surface of the horizontal component or a recessed section which fits slidably over a straight projection on the upper surface of the horizontal component. For example, the horizontal component may have a substantially planar bottom surface. The pedestal may comprise additional components (or "elements", "pieces", or "members") underneath the horizontal component, and the bottom surface of the horizontal component is configured so that it is located on top of the additional components, wherein said additional components may be, for example, additional pedestal components such as base or blocks, and/or rectangular, square, round, cylindrical, oval, arches, curved, polygonal, and other shapes, serving as wall(s), a foot or feet, pad(s), leg(s), strut(s), column(s), plinth(s) or other structure. In certain embodiments, each of said length l and the width w is at least 20 times the thickness h. In certain embodiments, the upper surface of the horizontal component comprises a straight open channel and the vertical component comprises a projecting section which fits slidably into the straight open channel, and the open channel has a depth substantially equal to or less than the depth of the projecting section. In certain embodiments, said vertical component has a planar top surface, and the vertical component may have a core cross-section which is rectangular and has a width and a height such that the ratio of the width to the height of the core cross section is from 4:1 to 40:1. In certain embodiments, a plurality of said vertical components may be provided, each of which has a substantially constant generally rectangular core cross-section, a horizontal bottom surface comprising at least one configuration which is a projecting section which fits slidably into a straight open channel in the upper surface of a horizontal component or a recessed section which fits slidably over a straight projection on the upper surface of a horizontal component.

Certain embodiments of a pedestal may be described as comprising: a first horizontal component (or "element", "piece", or "member") which has a substantially constant, generally rectangular core cross-section having a horizontal width w, and a height h, w being at least 10 times h, a horizontal dimension, l, measured at right angles to the width, which is at least 10 times h, and (iii) a horizontal upper surface which includes a plurality of configurations selected from straight open channels and straight projections; and a first vertical component (or "element", "piece", or "member") which has a substantially constant, generally rectangular core cross-section, a horizontal bottom surface comprising at least one configuration which is a projecting section which fits slidably into a straight open channel in the upper surface of the first horizontal component or a recessed section which fits slidably over a straight projection on the upper surface of the first horizontal component; a second vertical component; and a second horizontal component which has a substantially constant, generally rectangular core cross-section having a horizontal width w, and a height h, w being at least 10 times h, a horizontal dimension, l, measured at right angles to the width, which is at least 10 times h, a horizontal upper surface which includes a plurality of configurations selected from straight open channels and straight projections; and a bottom surface which is configured so that it is located on top of the vertical components. In certain embodiments, there is a second vertical component (or "element", "piece", or "member") that has a substantially constant, generally rectangular core cross-section, and a horizontal bottom surface comprising at least one configuration which is a projecting section which fits slidably into a straight open channel in the upper surface of a horizontal component or a recessed section which fits slidably over a straight projection on the upper surface of a horizontal component, said horizontal component having a substantially constant, generally rectangular core cross-section having a horizontal width w, and a height h, w being at least 10 times h, a horizontal dimension, l, measured at right angles to the width, which is at least 10 times h, and a horizontal upper surface which includes a plurality of configurations selected from straight open channels and straight projections. In certain embodiments, the second vertical component has a substantially constant, generally rectangular core cross-section, and a horizontal bottom surface comprising at least one configuration which is a projecting section which fits slidably into a straight open channel in the upper surface of the first horizontal component or a recessed section which fits slidably over a straight projection on the upper surface of the first horizontal component. In certain embodiments, the first horizontal component has a substantially planar bottom surface.

In certain embodiments, the pedestal comprises additional components (or "elements", "pieces", or "members") underneath the first horizontal component, and the bottom surface of the first horizontal component is configured so that it is located on top of the additional components and may be fixed, connected, mated with, or engaged with said additional components, which additional components may be additional pedestal components such as bases or blocks, or wall(s), a foot or feet, pad(s), leg(s), strut(s), column(s), plinth(s), or other structure. In certain embodiments, the length l and the width w of the first horizontal component is at least 20 times the thickness h of the first horizontal component and the length l and the width w of the second horizontal component is at least 20 times the thickness h of the second horizontal component. In certain embodiments, each of the first and second horizontal components has length 1 and the width w is at least 40 times the thickness h.

Many, but not necessarily all, base embodiments are configured so that a midsection of each of the lower support members lies between a pair of base channels and has an open space underneath it. Such pedestal bases adapted for open space underneath the midsection of the lower support members comprise, for example: (i) a hollow tube having a substantially horizontal upper peripheral surface which defines the base channels and a substantially horizontal low peripheral surface, or (ii) two separate wall members, as in FIGS. 10-12 and 15-17 and 19 that preferably have flat, planar bottom surfaces. In FIGS. 10-12 and 15-17, and 19 the block is slidably fitted over a set of parallel straight lower support members 14 which are fitted into base channels of a pedestal base made up of two separate wall members 12, 12', 312, 312'.

Alternative base embodiments comprise channels in an upper surface for receiving lower support members, but not pairs of channels for receiving opposite ends of support members with the midsection of the support member lying between the base channels with open space underneath. For example, see base 12 in FIGS. 1-4 that may be considered a single-wall base with channels but not "pairs of channels". In FIGS. 15-17, for example, the lower support members 14 are slidably supported by the pairs of channels of two separate wall members 212, 212' of a base, but one end of the set of upper support members is slidably supported by a wall member that may be considered a tall, single-walled base 222 having channels. The single-walled base 222 reaches all the way up to support the upper support members rather than the lower support members. Also, in FIG. 51 includes an example of a base 710 that is a single member with upper surface channels, rather than a two-walled, cylindrical or other base with said "pairs of channels". FIGS. 23-46 are perspective views of various components that, alone or with other pedestal components, may be assembled into various pedestals, including but not limited to the pedestals of FIGS. 47-51 or other pedestals comprising multiple subassemblies. The components comprise horizontal components (specifically, platforms), vertical components that may be used as bases engaging the platforms and/or as blocks, and support members. Note that the vertical components of FIGS. 21-37 may serve as a base or base portions (directly above the platform, for example) and also a block (resting on support members, for example). Note that the vertical components of FIGS. 38-43 are preferably used as blocks resting on support members to provide a planar uppermost surface of the pedestal in that region for display objects; alternatively, but less preferably, the components of FIGS. 38-43 may be placed directly on a platform, for example, to support other overhanging components (for example, see components 820 and 850 in FIG. 51).

FIGS. 23-46 further illustrate how pedestal components (or "elements", "pieces", or "members") may be generally rectangular on all sides or generally cylindrical, for example, plus projections and recesses/channels as desired as adaptations for mating cooperation with each other. Other components shapes may be used, but generally rectangular cross-section and generally cylindrical cross-section components have been found to be especially effective for a modular system wherein the components are stackable in multiple layers, and further adjustable by sliding or rotating, to many sizes, shapes, and formations to suit the needs and preferences of the user. Other numbers and spacings of projections, recesses, and/or channels may be used.

Figure 23:
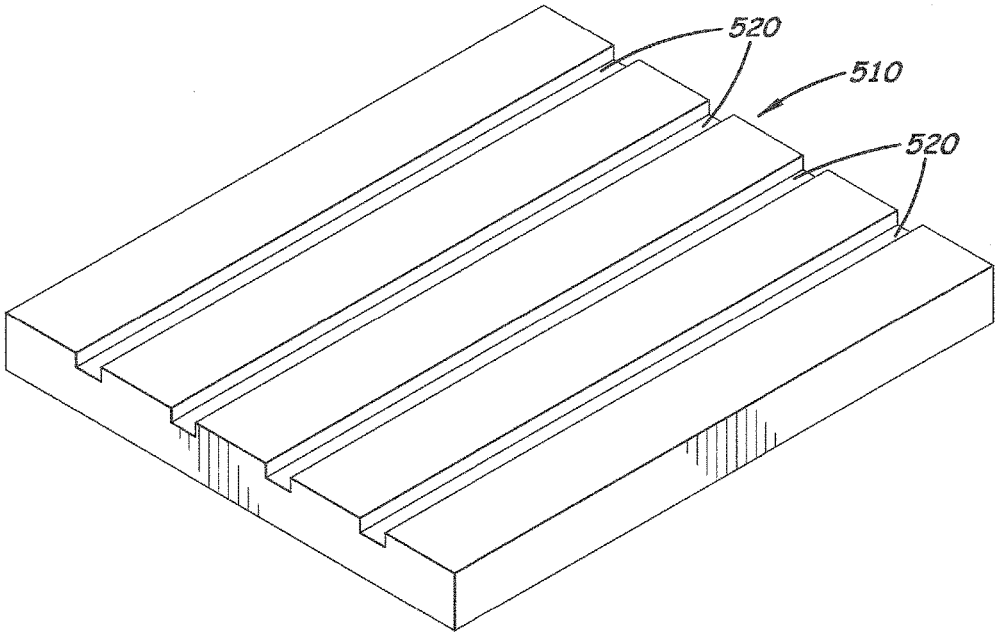
FIG. 23 is a top perspective view of an alternative platform, having upper surface open channels with open ends.
Figure 24:
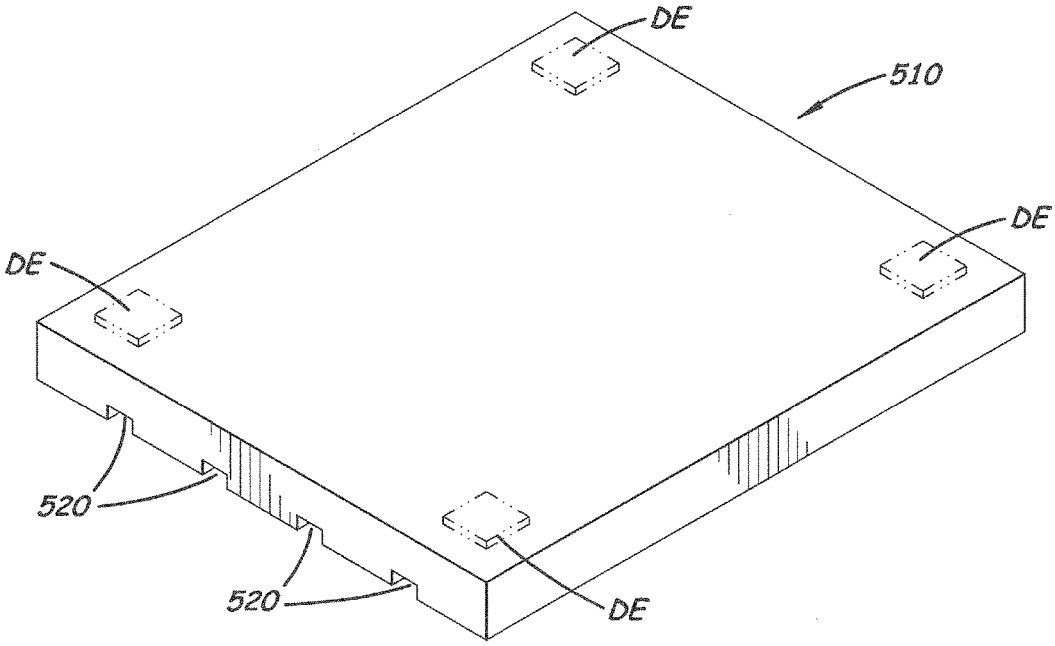
FIG. 24 is a bottom perspective view of the platform of FIG. 23, wherein one embodiment of an optional, supplemental downward-extension assembly, is shown in dashed lines and comprises four rectangular protrusions depending from the bottom surface of the platform.
Figure 25:
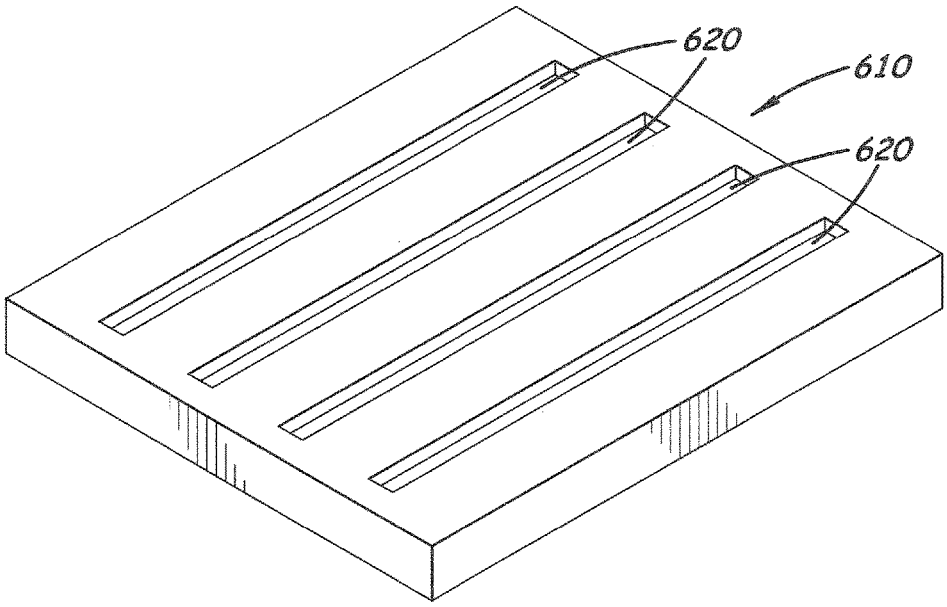
FIG. 25 is a top perspective view of yet another embodiment of a platform, having upper surface open channels with closed ends.
Figure 26:
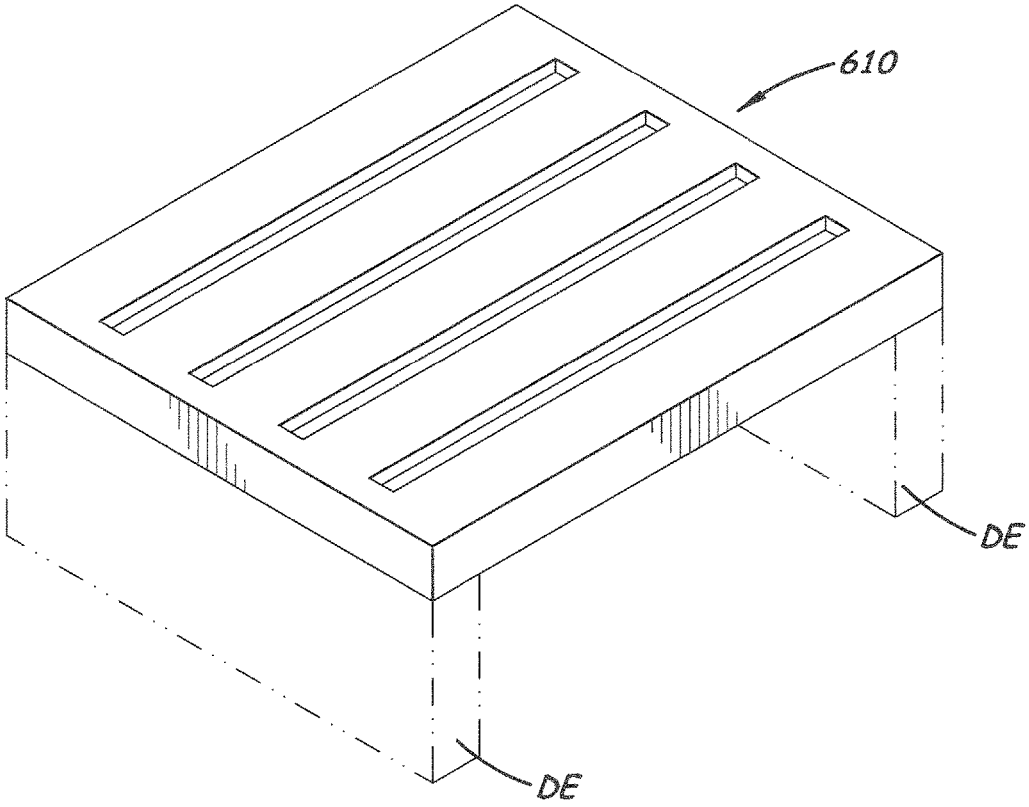
FIG. 26 is a top perspective view of the platform of FIG. 25 resting on and/or otherwise connected to two support walls as a supplemental downward-extension assembly.
Figure 27:
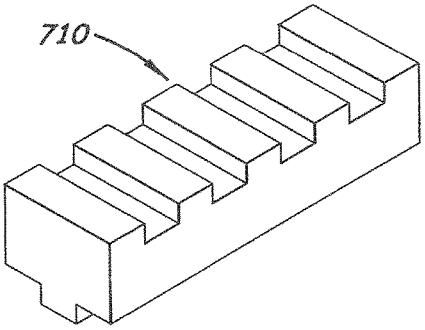
FIGS. 27-31 (including FIGS. 27, 27A and B, 28, 29, 29A, 30, 30A and B, and 31) are perspective views of vertical components each having a single bottom projection, and multiple upper channels that are transverse to the length of the projection, wherein length and height of the vertical components, number and spacing of the channels, and width of the bottom projection vary.
Figure 27A:
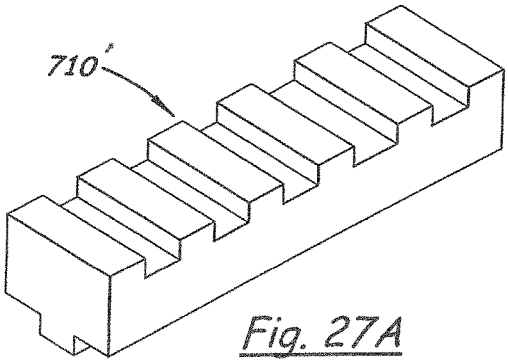
Figure 27B:
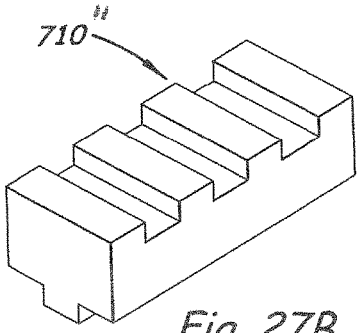
Figure 28:
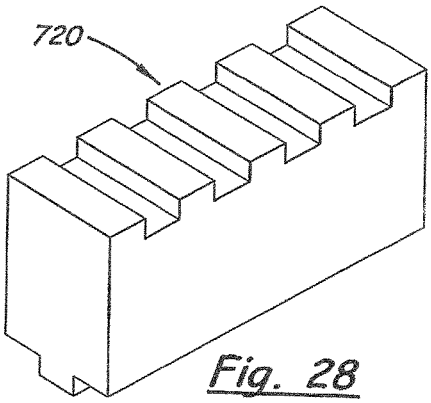
Figure 29:
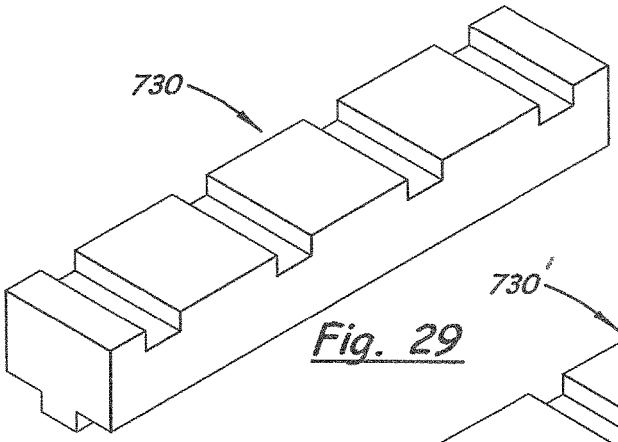
Figure 29A:
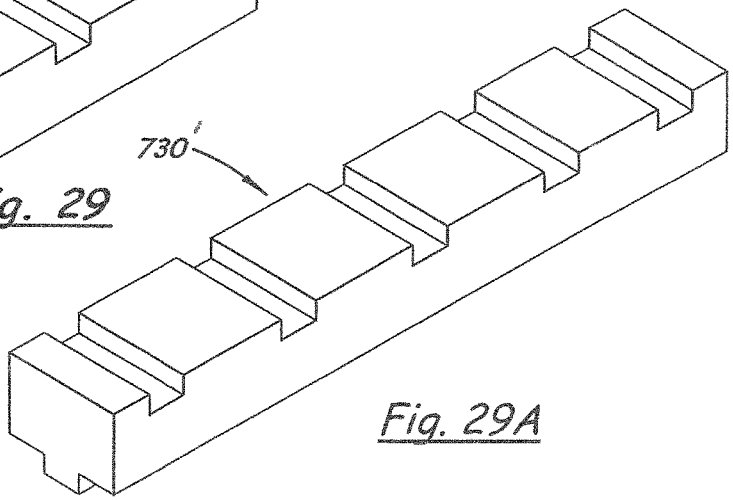
Figure 30:
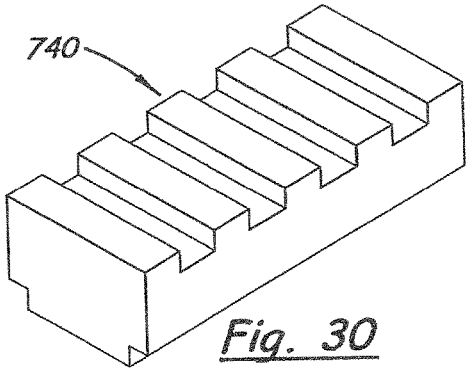
Figure 30A:
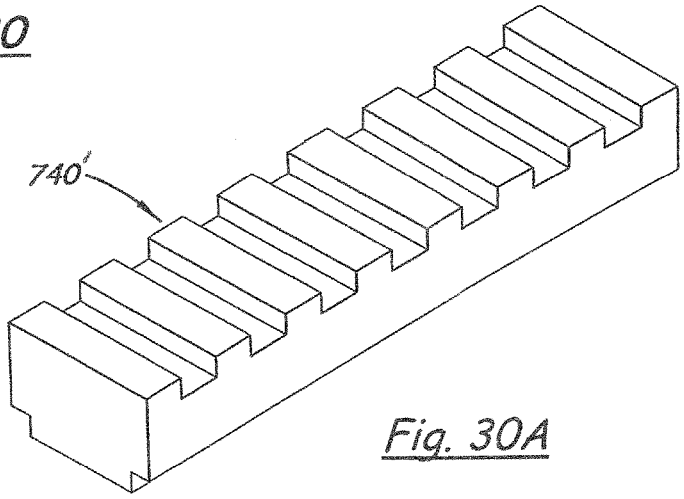
Figure 30B:
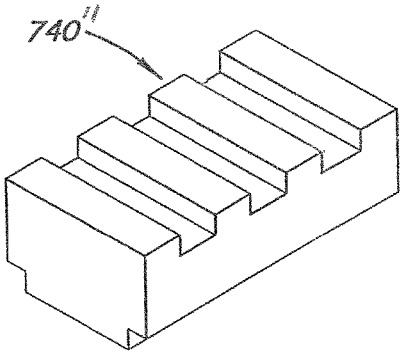
Figure 31:
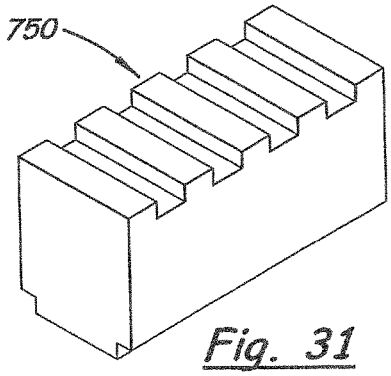

FIGS. 23-26 portray alternative platforms for supporting upper pedestal components (or "elements", "pieces", or "members"), preferably by vertically and horizontal sliding engagement between open-top channels in the upper surface of the platform and projections on the bottom surface of other pedestal components. Alternatively, but less preferably, said vertically and horizontal sliding engagement may be provided, instead or in addition, between projections upending from the upper surface of the platforms and recesses/channels on the bottom surface of other pedestal components. FIG. 23 is a top perspective view of a platform 510 having four open-top channels 520 with open ends. FIG. 24 is a bottom perspective view of the platform of FIG. 23, wherein an optional, supplemental downward-extension assembly DE, shown in dashed lines, comprises four rectangular protrusions depending from the bottom surface of the platform, which four protrusions are only one example of many shapes, numbers, and sizes or supplemental downward-extension assemblies that may be used. FIG. 25 is a top perspective view of yet another embodiment of a platform 610, having upper surface open-top channels 620 with closed ends. FIG. 26 is a top perspective view the platform of FIG. 25 resting on and/or otherwise connected to two support walls as a supplemental downward-extension assembly DE.

FIGS. 27-31 are perspective views of vertical components 710, 710', 710", 720, 730, 730', 740, 740', 740", 750, each having a single bottom projection, and multiple upper channels that are transverse to the length of the projection, wherein length and height of the components, number and spacing of the channels, and width of the bottom projection vary. Note that component 740 is very similar to block 16. For example, vertical components 710, 710', and 710" are the same except that they have four, five, and three channels, respectively. Vertical components 730 and 730' are the same except that they have four and five channels, respectively. Vertical components 740, 740', 740" are the same except that they have four, five, and three channels, respectively. Also, it should be noted that the spacing of channels may be other than that shown in FIGS. 27-31, including other even spacing or even uneven spacing, and that support members may be inserted into all or less than all of the channels, thus, resulting in varying numbers of support members above the vertical components.

Figure 32:
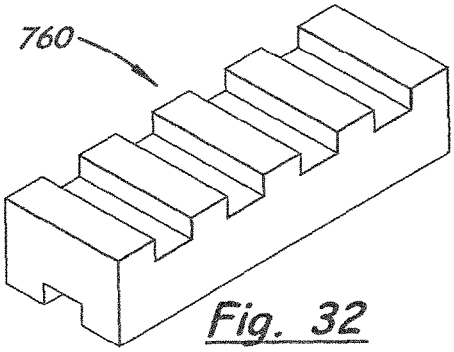
FIGS. 32 and 33 are perspective views of vertical components each having a single bottom channel, and multiple upper channels that are transverse to the length of the bottom channel, wherein the width of the component and its single bottom channel in FIG. 32 are wider than the component and bottom channel of FIG. 33.
Figure 33:
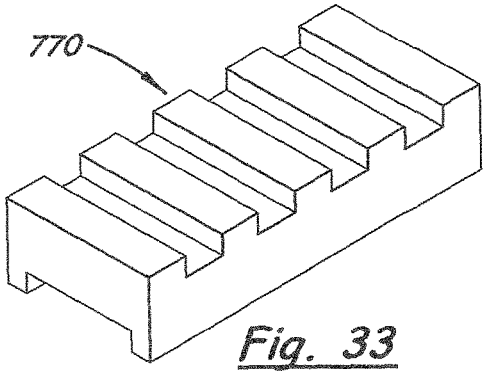

FIGS. 32 and 33 are perspective views of components 760, 770 each having a single bottom channel, and multiple upper channels that are transverse to the length of the bottom channel, wherein the width of the component 760 and its single bottom channel are wider than the component 770 and its bottom channel.

Figure 34:
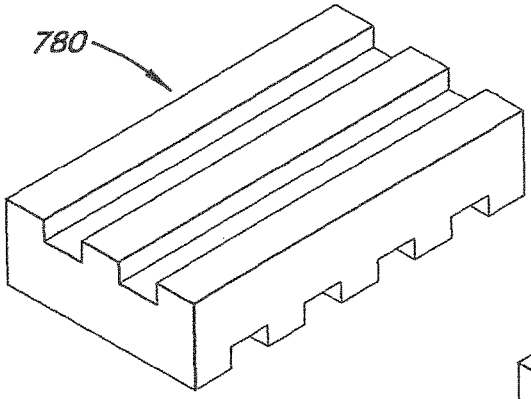
FIG. 34 is a perspective view of a vertical component having multiple bottom channels, and multiple upper channels that are transverse to the length of the bottom channels.

FIG. 34 is a perspective view of a component 780 having multiple bottom channels, and multiple upper channels that are transverse to the length of the bottom channels.

Figure 35:
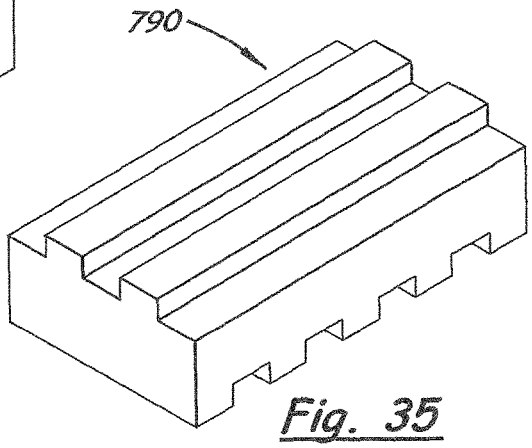
FIG. 35 is a perspective view of a vertical component having multiple bottom channels, and multiple upper projections that are transverse to the length of the bottom channels.

FIG. 35 is a perspective view of a component 790 having multiple bottom channels, and multiple upper projections that are transverse to the length of the bottom channels.

Figure 36:
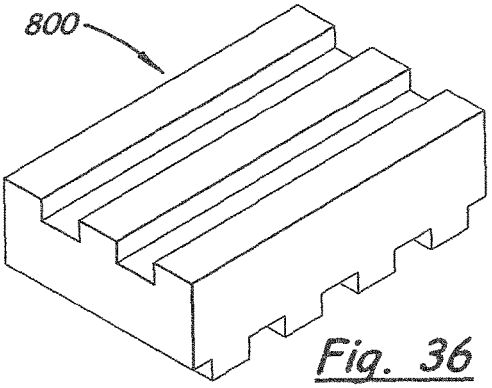
FIG. 36 is a perspective view of a vertical component having multiple bottom projections, and multiple upper channels that are transverse to the length of the bottom projections.

FIG. 36 is a perspective view of a component 800 having multiple bottom projections, and multiple upper channels that are transverse to the length of the bottom projections.

Figure 37:
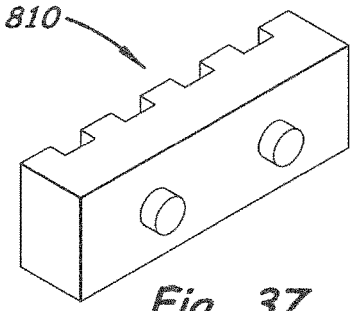
FIG. 37 is a bottom perspective view (the bottom facing toward the bottom right of the page) of a vertical component having multiple upper channels, and two bottom projections that are cylindrical.
Figure 38:
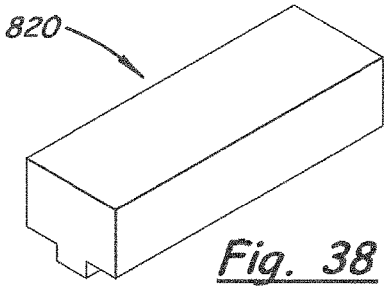
FIGS. 38 and 39 are perspective views of vertical components having single bottom projections, of different widths, and with planar upper surfaces.
Figure 39:
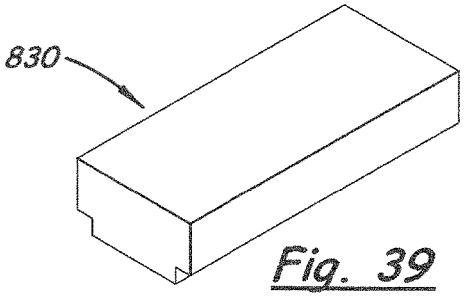

FIG. 37 is a bottom perspective view (the bottom facing toward the bottom right of the page) of a component 810 having multiple upper channels, and two bottom projections that are cylindrical. Certain vertical component embodiments have projections, recesses and/or channels on their bottom surfaces, but not on their upper surfaces. FIGS. 38 and 39 are perspective views of components 820, 830 having single bottom projections, of different widths, and with planar upper surfaces. FIGS. 40 and 41 are top and bottom perspective views, respectively, of a cylindrical component 840 that has four bottom channels for engaging support members, and a planar upper surface. FIGS. 42 and 43 are top and bottom perspective views, respectively, of an alternative platter component 850 that has only two bottom channels, spaced farther apart than in the platter component of FIGS. 40 and 41, for engaging support members, and a planar upper surface. The planar, and preferably continuous upper surface, of each of components 820, 830, 840, 850 are beneficial for these components to be used as an uppermost layer in a region of the pedestal, for example, for receiving and supporting display objects where the user wishes not to display the objects in that region on a discontinuous surface formed by multiple support members. The planar, and preferably continuous upper surfaces may optionally be for supporting other pedestal components.

Vertical components of FIGS. 27-37 each have adaptations on their bottom surfaces and their upper surfaces for engaging components that are below and above them, respectively, wherein said components below and above may be horizontal components and/or other vertical components as desired. It may be noted that these, and many other, vertical components may be installed and used interchangeably in multiple, and even any, layer or position of the pedestal, for example, as bases, base portions, or blocks. It may also be noted that said engaging is preferably detachable engaging, and most preferably engaging by means of vertical and/or horizontal (and preferably both) sliding relative to said components below and above them. Once the vertical components are installed and adjusted to their preferred relative locations, by said vertical and horizontal sliding, to produce the preferred pedestal size, shape, and appearance, the vertical components and horizontal components of the pedestal will typically not be slid or otherwise adjusted out of their relative locations during use in a given display or event.

FIGS. 44-46 are perspective views of three support member embodiments, the figures each including a cross-sectional portion to illustrate the inside of the support members. Support member 860 is a solid support member that is rectangular on all sides, with the cross-section and end view being square. This support member is the same or very similar to support members 14 and 18. Support member 870 is generally U-shaped in cross-section and in end view. Support member 880 is a hollow support member that is rectangular on all sides, with the cross-section and end view being hollow squares.

Note that the support members may be made in various lengths, as desired, for example, from about 5 inches to about 10 feet, preferably 5 inches to 5 feet, or more preferably about 1 foot, 2 feet, 3 feet, 4 feet, or 5 feet long. Support members installed together on a given base, given base portions, or a given block or blocks, preferably spaced slightly apart but parallel to each other, may be called a "set" of support members. The pieces of a set of support members may all be the same length, of two or more lengths, or all different lengths.

In many embodiments, the vertical and horizontal components, including but not limited to those shown in FIGS. 23-46, may be formed into pedestals wherein they are detachable and only secured to each other by gravity. This is accomplished preferably by the components sliding horizontally in at least one direction, and/or vertically in at least one direction, relative to each other; for example, the vertical sliding may comprise, consist essentially of, or consist only of vertical movement of the components during stacking of the layers. The especially-preferred pedestals consist essentially of, or consist only of, vertical and horizontal components that are freely detachable and vertically and horizontally slidable relative to each other, and/or that are secured together only by gravity, without ties, clips, screws, nails, adhesive, tape, hook-and-loop fasteners, straps, or other fasteners. The pedestal components may be made of wood(s), metal(s), or polymer(s), with the weight of the components preferably sufficiently heavy that they typically will not accidently wobble, jiggle, or vibrate, out of the preferred alignment or off of the pedestal. Less preferably, fasteners may additionally be provided, for example, ties, clips, screws, nails, adhesive, tape, hook-and-loop fasteners, straps, or other fasteners, for securing one or more component to another during or after stacking and adjustment of the components. Also, in certain less-preferred embodiments, two or more components may be welded or integrally fixed together.

Figure 47:
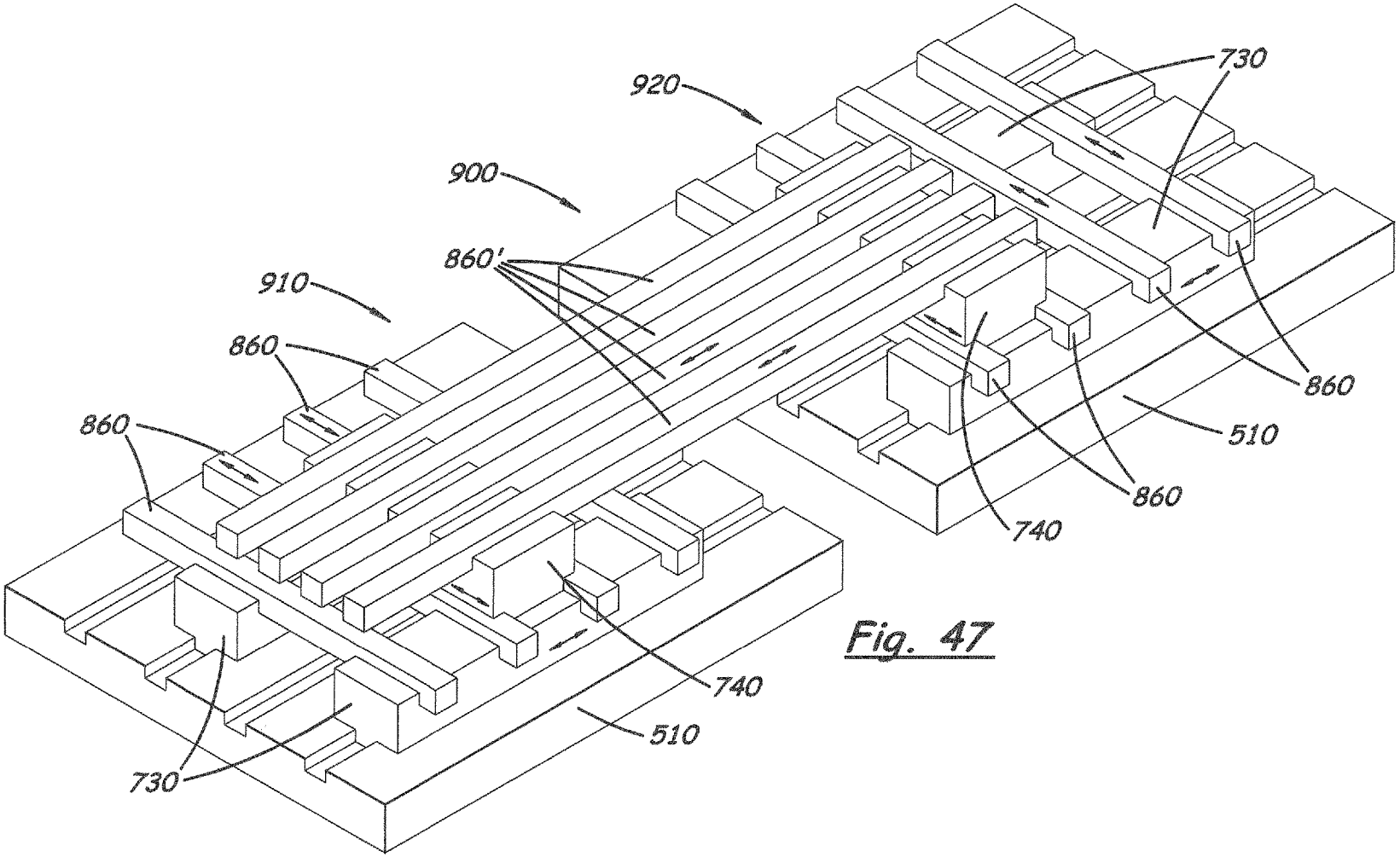

Preferably, the assemblies of FIGS. 47-51 are assembled of various components selected from FIGS. 23-46 and are preferably secured together only by gravity, with each component preferably being slidable relative to the component(s) below it (if any), and above it (if any). FIGS. 47-51 are top perspective views of pedestal assemblies, each comprising upper assemblies on each of two adjacent platforms and each comprising components that extend between the pedestals of both platforms. In FIG. 47, the pedestal 900 comprises two pedestal subassemblies 910, 920, each comprising a platform 510 that supports an upper assembly comprising two base portions 730, four relatively short support members 860 used as lower support members, and one block 740. Each subassembly 910, 920 may be described as a five-layer assembly (counting the platform and four layers above it). Also, four longer support members 860' are used as upper support members, and are supported by being slidably engaged with both blocks 740 of the pedestal 900. Thus, the long support members 860' extend from subassembly to subassembly, spanning the distance between them over a space existing between the two platforms 510. Thus, it may be seen that the components above a given platform may extend beyond that platform to another subassembly. Arrows are shown on some of the pieces of the subassemblies 910, 920 to illustrate horizontal sliding (slidability) of the components; it will be understood that, while arrows are drawn on only some of the pieces, all the components of a given type, shape, and/or location may horizontally slide in like manner, in certain embodiments. Also, it may be understood that various surfaces of the pedestal 900 may support display objects, for example, on the platforms 510 around and between the base portions 730, and on the lower support members 860 where they extend out from under the upper support members 860', and on the support members 860' above each platform but also above said space between the platforms.

Figure 48:
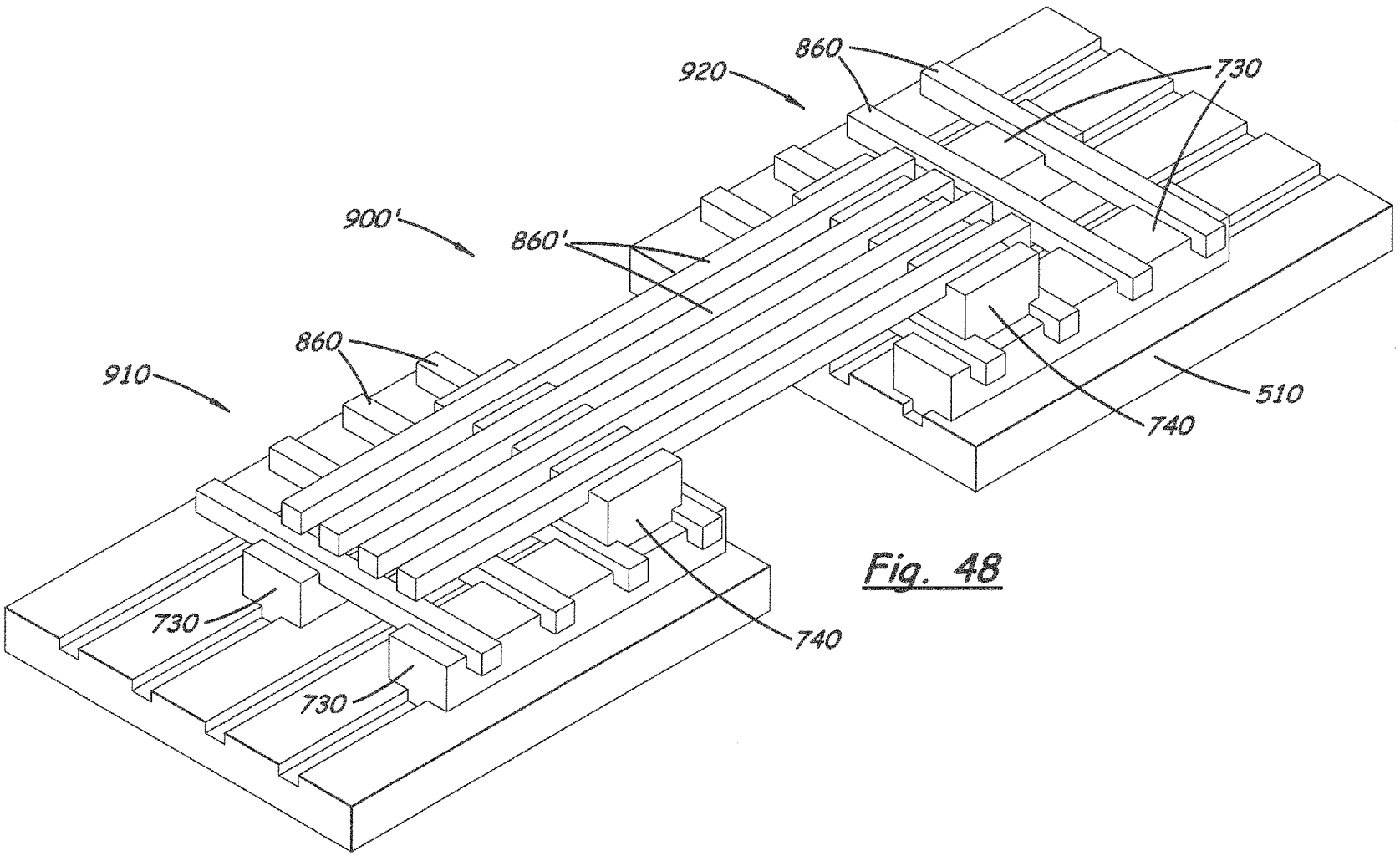

FIG. 48 illustrates one of the many ways that the components of subassemblies 910, 920 may be rearranged and adjusted for altering relative position of the components to form a second pedestal 900' similar to pedestal 900. Subassembly 910 is rearranged and adjusted by moving its block 740 to be between the two farther-right support members 860 (sliding upper support members 860' relative to the block below them), and by sliding its base portions 730 (with its carried support members 860 and block 740) nearly to the right edge of its platform 510. Subassembly 920 is adjusted by sliding its base portions 730 (with its carried support members 860 and block 740) nearly to the left edge of its platform 510.

Figure 49:
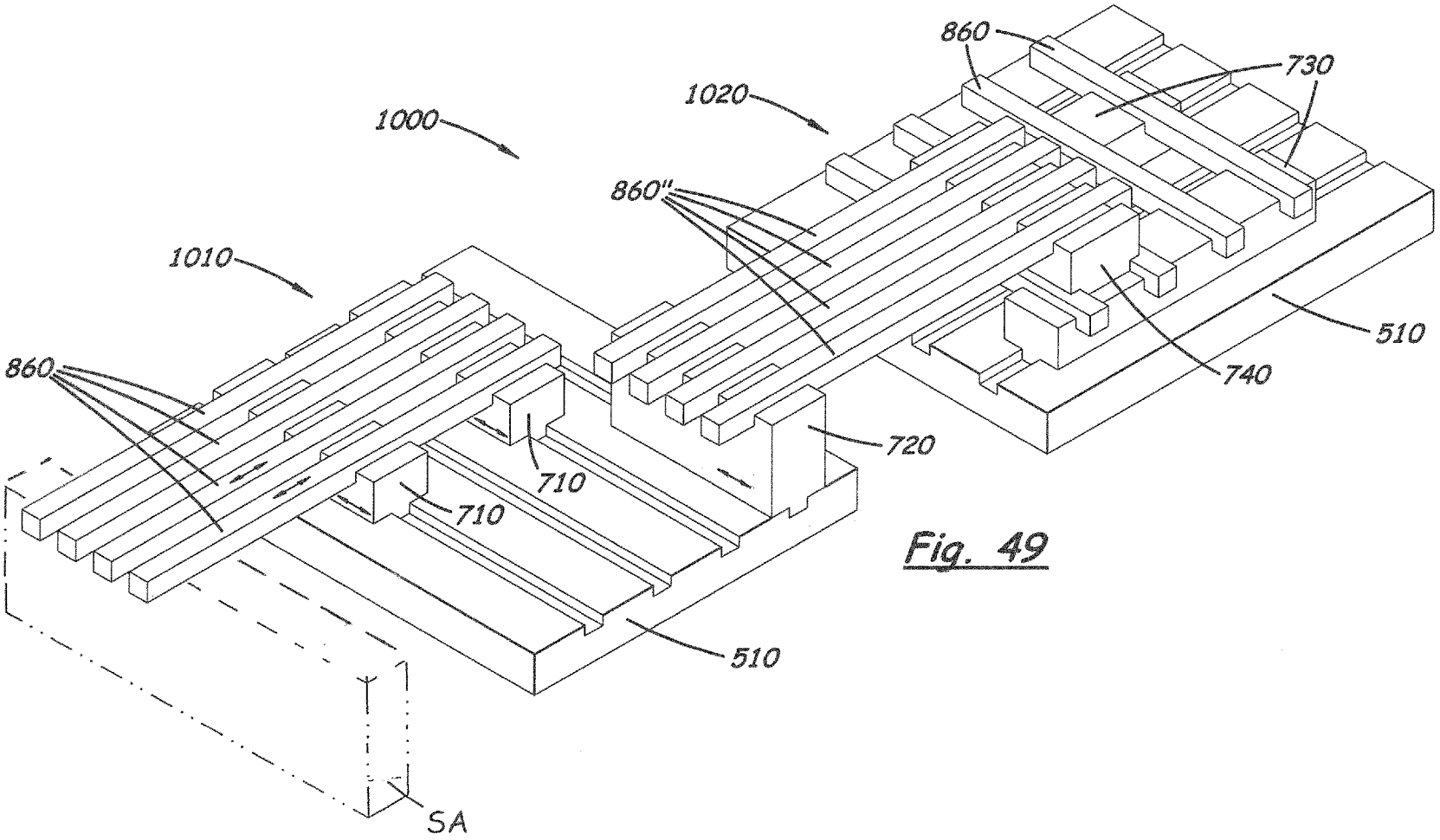

FIG. 49 illustrates a pedestal 1000 comprising two pedestal subassemblies 1010, 1020, wherein the right subassembly 1020 is assembled from the same components as subassembly 920 in FIGS. 47 and 48, while the left subassembly 1010 is assembled to include certain different components compared to subassembly 910 of FIGS. 47 and 48. Subassembly 1010 comprises platform 510 turned 90 degrees to the platform of subassembly 1020, two base portions 710 near an end of the platform and supporting additional support members 860, and tall base portion 720 near the opposite end of the platform, and supporting upper support members 860" (of intermediate length between members 860 and members 860' in FIGS. 47 and 48) extending from subassembly 1020. Subassembly 1010 may be described as a three-layer subassembly (counting the platform) and subassembly 1020 may be described as a five-layer subassembly (counting the platform). It will be understood from FIG. 47 that the components of subassembly 1020 in FIG. 49 preferably slide horizontally relative to the other components of the pedestal. In addition, arrows are shown on subassembly 1010 to illustrate horizontal sliding (slidability) of the components, in which it will be understood that, while arrows are drawn on only some of the pieces, all the components of a given type, shape, and/or location may horizontally slide in like manner, in certain embodiments. Arrows for vertical slidability are not shown but will be understood, as the components are preferably laid down one on top of another in a stacking motion/layering motion. Again, it may be seen that the components above a given platform may extend beyond the platform to another subassembly, spanning the space between the two platforms. It may be understood that a portion of one or both subassemblies 1010, 1020 may extend to yet another subassembly (or to multiple other subassemblies) of similar or different pedestal components, for example, as represented by the support members 860 of subassembly 1010 extending to engage, and be part of a layer of, a third subassembly SA. Subassembly SA is shown schematically in dashed lines, but it should be understood that subassembly SA may comprise a platform, base(s), block(s), and other support members, in certain embodiments. It may be understood that various surfaces of the pedestal 1000 may support display objects, for example on the platform 510 around and between the base portions 710, 720, and on the lower support members 860, and on support members 860".

Figure 50:
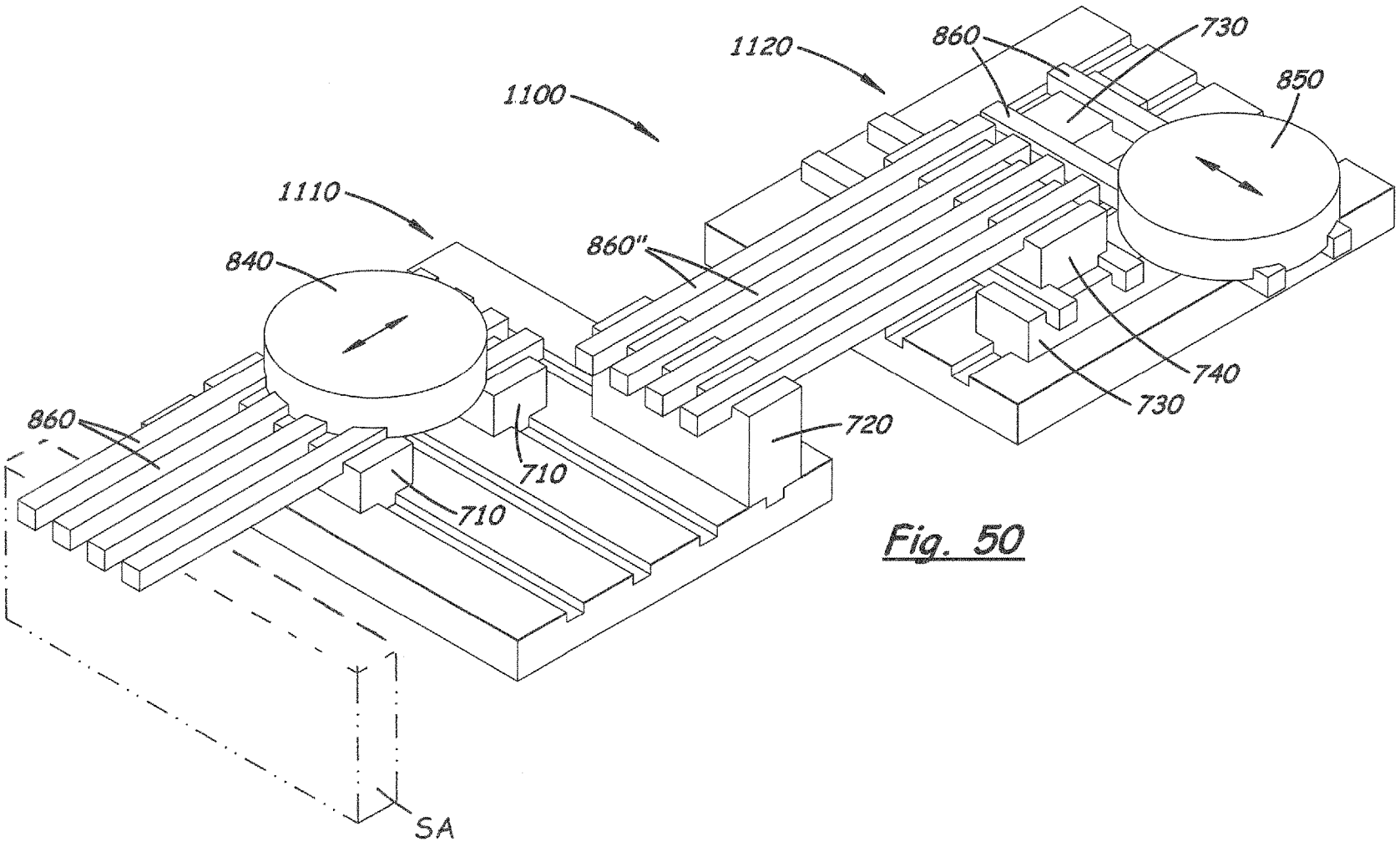

FIG. 50 illustrates a pedestal 1100 comprising two pedestal subassemblies 1110, 1120. The left subassembly 1110 is assembled from the same components as subassembly 1010 in FIG. 49 plus a planar-topped block 840. The right subassembly 1120 is assembled from the same components as subassembly 1020 in FIG. 49 plus a planar-topped block 850, with two of the support members 860 slid farther toward one edge of the platform. Subassembly 1110 may be described as a combination of four-layers and three-layers (each counting the platform) and subassembly 1120 may be described as a combination of five-layers and four-layers (each counting the platform). It will be understood from previous figures that the components of subassembly in FIG. 50 preferably slide horizontally relative to the other components of the pedestal. Arrows are shown in FIG. 50 to illustrate sliding of planar-topped blocks 840 and 850. Arrows for vertical slidability are not shown but will be understood, as the components are preferably laid down one on top of another in a stacking motion/layering motion. Again, it may be seen that the components above a given platform may extend beyond the platform to another subassembly, spanning the space between the two platforms. Preferably each component is slidable relative to the component(s) below it (if any), and above it (if any). A portion of one or both subassemblies 1110, 1120 may extend to yet another subassembly (or to multiple other subassemblies) of similar or different pedestal components, for example, as represented by the support members 860 of subassembly 1110 extending to engage, and be part of a layer of, a third subassembly SA, wherein subassembly SA may comprise a platform, base(s), block(s), and other support members, in certain embodiments. It may be understood that various surfaces of the pedestal 1100 may support display objects, for example on the platform 510 around and between the base portions 710, 720, 730, and on lower support members 860, 860" and blocks 840, 850.

Figure 51:
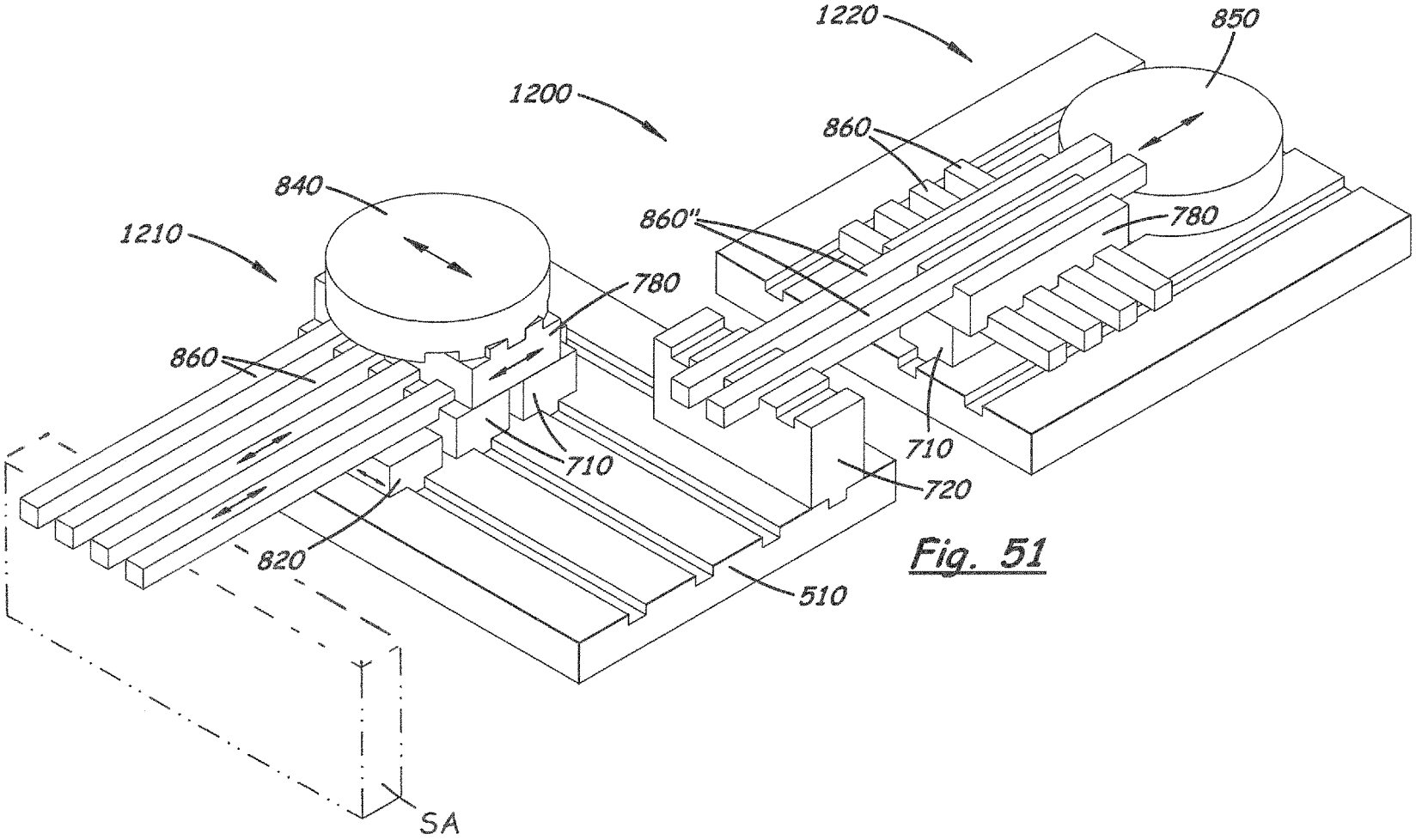

FIG. 51 illustrates another pedestal 1200, comprising left subassembly 1210 and right subassembly 1220. One may see that, in one region of subassembly 1210, a planar-topped block 840 rests on a block 780, which rests on four support members 860, which rest on a combination of three adjacent vertical components, that is, two components 710 and one planar-topped component 820, which rest on the platform 510, each being slidable relative to the component(s) below it. In another region of subassembly 1210, tall base portion 720 supports two support members 860" that extend to subassembly 1220. The two support members 860" rest on a block 780, which rests on four lower support members 860, which rest on a single vertical component 710 used as a base, which rests on the platform 510. It will be understood from previous figures that the components of subassembly in FIG. 51 preferably slide horizontally relative to the other components of the pedestal. Arrows are shown in FIG. 51 to illustrate sliding of blocks 780, 840, 850 and support members, 860. Arrows for vertical slidability are not shown but will be understood, as the components are preferably laid down one on top of another in a stacking motion/layering motion. A portion of one or both subassemblies 1210, 1220 may extend to yet another subassembly (or to multiple other subassemblies) of similar or different pedestal components, for example, as represented by the support members 860 of subassembly 1210 extending to engage, and be part of a layer of, a third subassembly SA, wherein subassembly SA may comprise a platform, base(s), block(s), and other support members, in certain embodiments.

Elongated support members preferably without projections or recesses/channels are shown in FIGS. 47-51 extending between subassemblies of a multiple-platform pedestal. Alternatively or in addition, other pedestal components may extend between subassemblies, for example, vertical components such a base or a block (including those that have planar top surfaces). Further, components of different dimensions, different projection and recess/channel numbers and spacings, and different surface areas and shapes, may be used in pedestals comprising multiple subassemblies, including as components that extend between said subassemblies. For example, in certain embodiments, base or blocks, including those extending between subassemblies, may be other than generally-rectangular, for example, oval, triangular, or other shapes.

Therefore, certain embodiments may be described as a pedestal comprising: at least two layers (or at least three) pedestal layers stacked generally vertically (or at least two horizontal layers generally on top of one another), wherein each layer comprises one or more components that are slidable relative to components of another of the layers of the pedestal and at least one of the layers is horizontally slidable relative to another of said layers of the pedestal; in such embodiments it is preferred that at least one layer comprises at least one vertical component and at least one layer comprises horizontally-elongated support members having first ends, second ends, and midsections between the first and second ends, wherein said first ends are supported at least in part by said vertical component and the support members extend horizontally away from said vertical component, so that upper surfaces of said midsections lie on a horizontal plane for receiving display objects. In certain embodiments, the at least two layers are secured to each other only by gravitational force. In certain embodiments, the pedestal comprises at least three layers, and at least two of the layers are interchangeable. In certain embodiments, the pedestal comprises at least two layers of said horizontally-elongated support members, and at least two layers of said vertical components, and wherein the layers of support members are interchangeable and the layers of vertical components are interchangeable. In certain embodiments as described in any sentence of this paragraph, one or more slidable components may be slidable both vertically and horizontally. The pedestal may comprise in some embodiments at least three layers, including a bottom layer that may be a platform that has a horizontal width w, a horizontal dimension l transverse to said width w, and a height h, wherein w is at least 10 times h, and l is at least 10 times h. Or, the bottom layer of said at least three layers may be a platform that has a horizontal width w, a horizontal dimension l transverse to said width w, and a height h, wherein w is at least 20 times h, and l is at least 20 times h. In certain embodiments, a first layer of at least three layers is a platform that has a horizontal width w, a horizontal dimension l transverse to said width w, and a height h, wherein w is at least 10 times h, and l is at least 10 times h; a second layer, on top of said platform, comprises multiple base portions that slidably engage the platform to slide horizontally on the platform and that have upper surface channels; and a third layer, on top of the second layer, comprises said support members slidably received in said upper surface channels of the base portions. In certain embodiments, the pedestal comprises at least four layers including at least two layers of said horizontally-elongated support members, and at least two layers of said vertical components. Certain embodiments may be described as said at least two layers being in a first subassembly, and the pedestal may further comprising a second subassembly adjacent to the first subassembly and comprising: at least two pedestal layers stacked generally vertically, wherein at least one of the layers of the second subassembly is horizontally slidable relative to another of the layers of the second subassembly; and wherein at least one layer of the second subassembly comprises a vertical component and at least one layer of the second subassembly comprises said second ends of said horizontally-elongated support members supported by said vertical components of the second subassembly, so that portions of said support members are between said first and second subassemblies.

Certain embodiments may be described as a pedestal comprising a first subassembly and a second subassembly, the first subassembly comprising: at least three layers stacked generally vertically, wherein at least one of the layers is horizontally slidable relative to another of the layers of the first subassembly; and at least one of said three layers comprising a vertical component and at least one layer of the three layers comprising elongated horizontally-elongated support members each having a first end engaging said vertical component and a second end extending horizontally away from said vertical component; and the second subassembly comprising: at least two pedestal layers stacked generally vertically, wherein at least one of the layers of the second subassembly is horizontally slidable relative to another of the layers of the second subassembly; wherein at least one layer of the second subassembly comprises a vertical component and at least one layer of the second subassembly comprises said second end of said horizontally-elongated support members extending horizontally from the first assembly, so that a midsection of each of said support members has an upper surface that lies on a horizontal plane between said first and second subassemblies for receiving display objects. Certain embodiments may comprise additionally a third, fourth, or more subassemblies, wherein each subassembly may be constructed from any of the pedestal components described herein, and preferably one or more layers of the subassemblies being connected by mutual components/layers.

Although this invention has been described above with reference to particular means, materials and embodiments, it is to be understood that the invention is not limited to these disclosed particulars, but extends instead to all equivalents within the scope of the following claims.

The invention claimed is:

1. A pedestal having components that are horizontally-slidably adjustable to form multiple pedestal configurations, the pedestal comprising:

at least two pedestal layers stacked generally vertically and secured to each other only by gravitational force, wherein at least one of said at least two layers is horizontally slidable relative to another of said layers of the pedestal to adjust the pedestal into said multiple pedestal configurations; and wherein at least two layers comprise at least one vertical component and at least two layers comprise horizontally-elongated support members having first ends, second ends, and midsections between the first and second ends, wherein said first ends are supported by said vertical component and the support members extend horizontally away from said vertical component, so that upper surfaces of said midsections lie on a horizontal plane for receiving display objects such as tableware, foodstuffs for consumption, and other objects displayed for commercial or aesthetic purposes; and wherein the at least two pedestal layers comprise:

a first, bottom layer that is a platform that has a horizontal width w, a horizontal dimension l transverse to said width w, and a height h, wherein w is at least 10 times h, and l is at least 10 times h;

a second layer, on top of said platform, comprising at least one of said vertical components that horizontally-slidably engages the platform; and a third layer, on top of the second layer, comprising a plurality of said horizontally-elongated support members, and a fourth layer, on top of the third layer, comprising at least one of said vertical components that horizontally-slidably engages the third layer; and a fifth layer, on top of the fourth layer, comprises a plurality of said horizontally-elongated support members; and wherein the second and fourth layer are interchangeable and the third and fifth layer are interchangeable.

2. The pedestal of claim 1, wherein said at least one layer that is horizontally slidable relative to another of said layers is slidable both vertically and horizontally.

3. A pedestal comprising:

at least three pedestal layers stacked generally vertically and secured to each other only by gravitational force, wherein at least two of the layers are interchangeable; and wherein:

each layer comprises one or more components that are slidable relative to components of another of the layers of the pedestal;

at least one of said at least three layers is horizontally slidable relative to another of said layers of the pedestal; and at least one layer comprises at least one vertical component and at least one layer comprises horizontally-elongated support members having first ends, second ends, and midsections between the first and second ends, and wherein said first ends are supported by said vertical component and the support members extend horizontally away from said vertical component, so that upper surfaces of said midsections lie on a horizontal plane for receiving display objects, such as tableware, foodstuffs for consumption, and other objects displayed for commercial or aesthetic purposes; and wherein:

a first layer of said at least three layers is a platform that has a horizontal width w, a horizontal dimension l transverse to said width w, and a height h, wherein w is at least 10 times h, and l is at least 10 times h;

a second layer, on top of said platform, comprises multiple base portions that slidably engage the platform to slide horizontally on the platform and that have upper surface channels; and a third layer, on top of the second layer, comprises said support members slidably received in said upper surface channels of the base portions.

4. A pedestal comprising a first subassembly and a second subassembly, wherein:

the first subassembly comprises:

at least three layers stacked generally vertically, wherein at least one of the layers is horizontally slidable relative to another of the layers of the first subassembly; and at least one of said three layers comprising a vertical component and at least one layer of the three layers comprising elongated horizontally-elongated support members each having a first end engaging said vertical component and a second end extending horizontally away from said vertical component; and wherein the second subassembly comprises:

at least two pedestal layers stacked generally vertically, wherein at least one of the layers of the second subassembly is horizontally slidable relative to another of the layers of the second subassembly;

wherein at least one layer of the second subassembly comprises a vertical component and at least one layer of the second subassembly comprises said second end of said horizontally-elongated support members extending horizontally from the first subassembly, so that a midsection of each of said support members has an upper surface that lies on a horizontal plane between said first and second subassemblies for receiving display objects, such as tableware, foodstuffs for consumption, and other objects displayed for commercial or aesthetic purposes; and wherein the first subassembly comprises:

a first layer of said at least three layers that is a platform that has a horizontal width w, a horizontal dimension l transverse to said width w, and a height h, wherein w is at least 10 times h, and l is at least 10 times h;

a second layer, on top of the platform, comprising said vertical component that slidably engages the platform to slide horizontally on the platform and that has upper surface channels; and a third layer, on top of the second layer, comprising the first ends of the support members slidably received in said upper surface channels of the vertical component.

5. The pedestal of claim 4, wherein said first subassembly further comprises a second vertical component in an upper most layer of the first subassembly and having a planar upper surface for receiving said display objects.

6. The pedestal of claim 4, wherein the second subassembly comprises a platform as a bottom layer, and a space exists between the platform of the first subassembly and the platform of the second subassembly, and said midsection of each of said support members extends over said space.

7. The pedestal of claim 4, comprising at least four of said support members.

8. The pedestal of claim 4, wherein the layers of the first subassembly are secured to each other only by gravitational force.

9. The pedestal of claim 8, wherein the layers of the second subassembly are secured to each other only by gravitational force.

10. The pedestal of claim 4, wherein said first subassembly further comprises a generally cylindrical vertical component having a top surface for receiving said display objects.

11. A pedestal comprising a first subassembly and a second subassembly, wherein:

the first subassembly comprises:

at least three layers stacked generally vertically, wherein at least one of the layers is horizontally slidable relative to another of the layers of the first subassembly; and at least one of said three layers comprising a vertical component and at least one layer of the three layers comprising elongated horizontally-elongated support members each having a first end engaging said vertical component and a second end extending horizontally away from said vertical component; and wherein the second subassembly comprises:

at least two pedestal layers stacked generally vertically, wherein at least one of the layers of the second subassembly is horizontally slidable relative to another of the layers of the second subassembly;

wherein at least one layer of the second subassembly comprises a vertical component and at least one layer of the second subassembly comprises said second end of said horizontally-elongated support members extending horizontally from the first subassembly, so that a midsection of each of said support members has an upper surface that lies on a horizontal plane between said first and second subassemblies for receiving display objects, such as tableware, foodstuffs for consumption, and other objects displayed for commercial or aesthetic purposes; and wherein the second subassembly comprises at least three layers comprising:

a first layer that is a platform that has a horizontal width w, a horizontal dimension l transverse to said width w, and a height h, wherein w is at least 10 times h, and l is at least 10 times h; and a second layer, on top of the platform, that comprises said vertical component that slidably engages the platform to slide horizontally on the platform and that has upper surface channels; and a third layer, on top of the second layer, comprising said second end of the support members extending from the first subassembly.

12. The pedestal of claim 11, wherein said second subassembly further comprises a second vertical component in an upper most layer of the second subassembly and having a planar upper surface for receiving said display objects.

13. The pedestal of claim 11, wherein the first subassembly comprises a platform as a bottom layer, and a space exists between the platform of the first subassembly and the platform of the second subassembly, and said midsection of each of said support members extends over said space.

14. The pedestal of claim 11, comprising at least four of said support members.

15. The pedestal of claim 11, wherein the layers of the first subassembly are secured to each other only by gravitational force.

16. The pedestal of claim 15, wherein the layers of the second subassembly are secured to each other only by gravitational force.

17. The pedestal of claim 11, wherein said second sub-assembly further comprises a generally cylindrical vertical component having a top surface for receiving said display objects.

* * * * *